United States Patent [19]

Tanahashi et al.

[11] Patent Number: 4,493,149

[45] Date of Patent: Jan. 15, 1985

[54] RECIPROCAL BLADE ASSEMBLY OF ELECTRIC SHAVER

[75] Inventors: Masao Tanahashi; Toshio Tanabe; Kiyotaka Otsuka, all of Hikone, Japan

[73] Assignee: Matsushita Electric Works, Ltd., Osaka, Japan

[21] Appl. No.: 418,083

[22] Filed: Sep. 14, 1982

Related U.S. Application Data

[63] Continuation of Ser. No. 191,518, Sep. 29, 1980, abandoned.

[30] Foreign Application Priority Data

Mar. 15, 1980 [JP] Japan ..... 55-33271
May 27, 1980 [JP] Japan ..... 55-70924

[51] Int. Cl.[3] ..... B26B 19/04
[52] U.S. Cl. ..... 30/43.92
[58] Field of Search ..... 30/43, 43.7–43.92

[56] References Cited

U.S. PATENT DOCUMENTS

| | | | |
|---|---|---|---|
| 2,629,169 | 2/1953 | Kleinman | 30/43.92 X |
| 3,098,295 | 7/1963 | Wahl | 30/43.92 |
| 3,648,367 | 3/1972 | Tolmie | 30/43.92 X |
| 3,811,188 | 5/1974 | Brenneman et al. | 30/43.92 X |
| 3,967,373 | 7/1976 | Sakai et al. | 30/43.92 |
| 4,133,103 | 1/1979 | Beck | 30/43 |
| 4,393,586 | 7/1983 | Hamashima et al. | 30/43.6 |

*Primary Examiner*—James G. Smith
*Attorney, Agent, or Firm*—Burns, Doane, Swecker & Mathis

[57] ABSTRACT

Reciprocal blade assembly of electric shaver having means for positively shaving specifically such long beard hair as ones extending along user's face skin or curling which are hard to shave, in addition to ordinary beard hair easy to shave. The means comprises an elongated bent part and slit-shaped hair inlet apertures made in an outer blade of a flexible steel foil fixed as bent semicylindrically to the shaver's head, the bent part being parallel to the longitudinal axis of the blade and the slit-shaped apertures substantially transversing the bent part, and an undulated part corresponding to the bent part and made in respective arcuate cutting blade edges of an inner cutter driven reciprocally to slide at the edges along the inner surface of the outer blade. Other hair inlet apertures made in the outer blade on both sides of the bent part for shaving mainly the ordinary hair are made, for example, to vary in diameter to gradually reduce rigidity against the bending of the outer blade as farther separated sideward from the bent part, whereby intimate contact between the semicylindrically bent outer blade and the inner cutter blade edges is maintained.

2 Claims, 90 Drawing Figures

Fig. 7
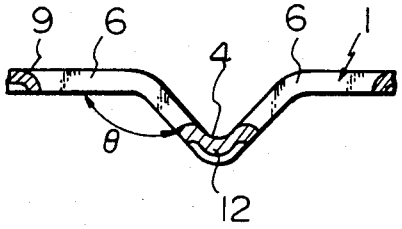
Fig. 8
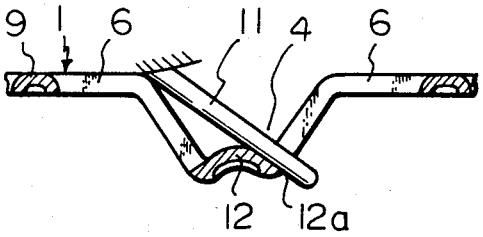
Fig. 9A
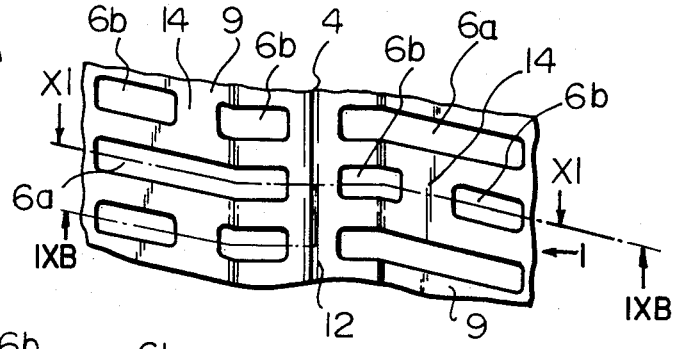
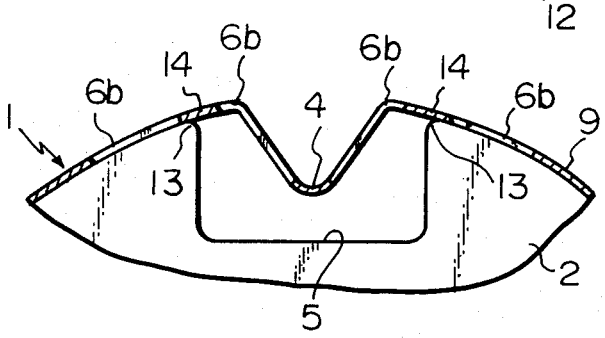
Fig. 9B
Fig. 9C
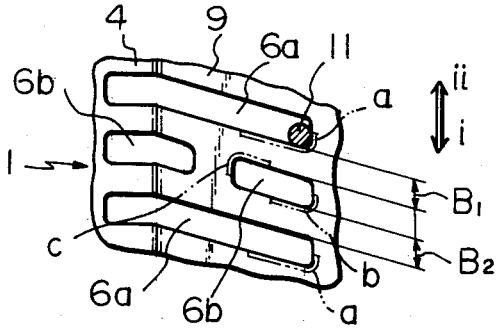

Fig. 10A
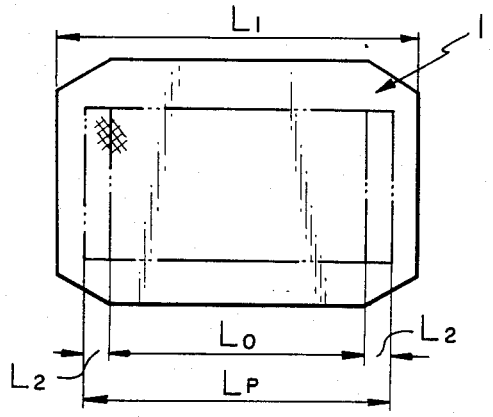
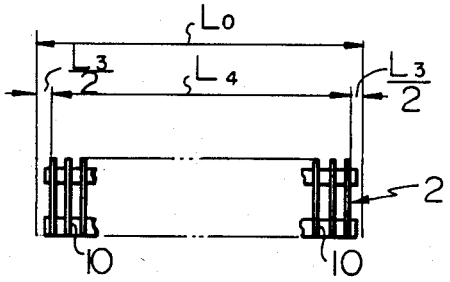
Fig. 10B
Fig. 11
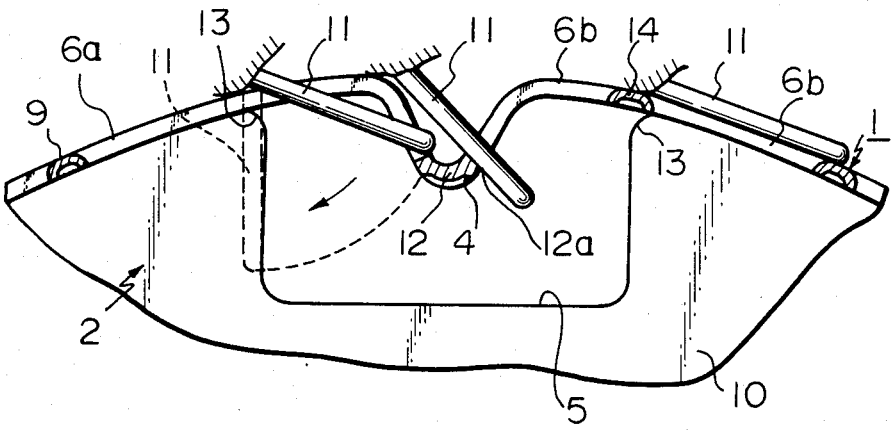

Fig. 25
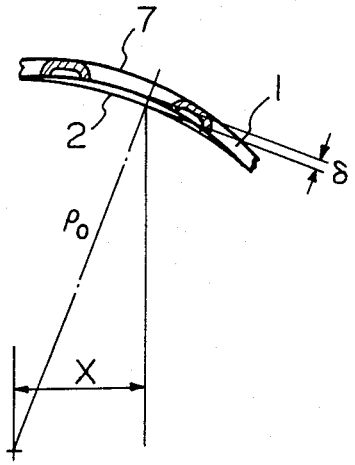
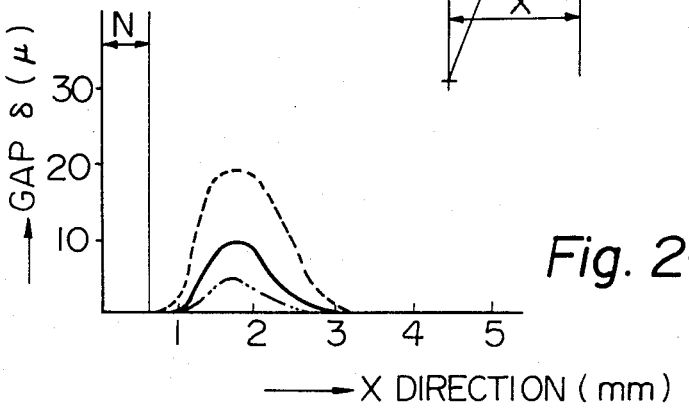
Fig. 26
Fig. 27
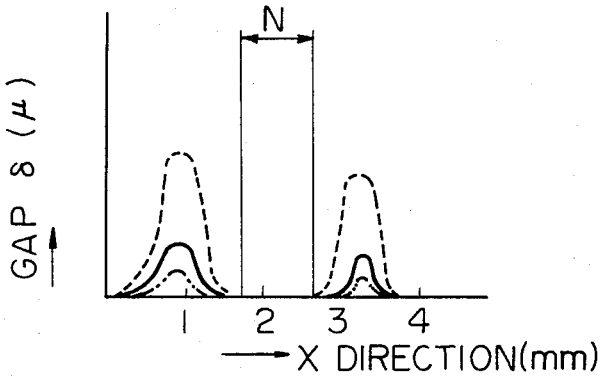

Fig. 31
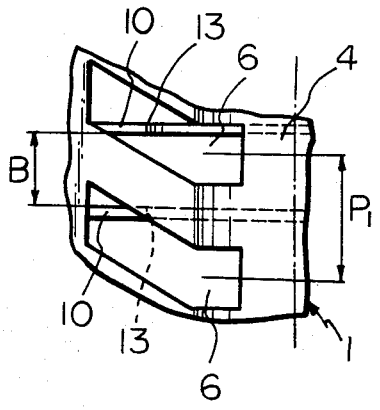
Fig. 32A
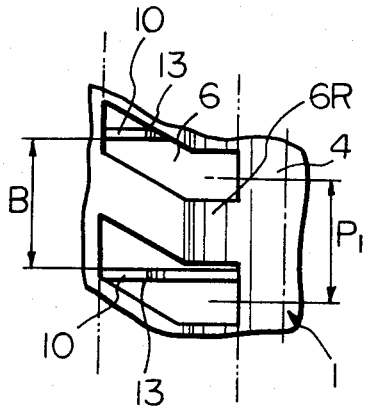
Fig. 32B
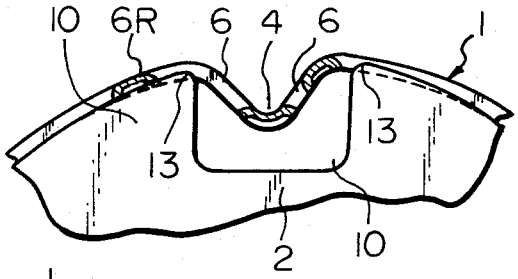
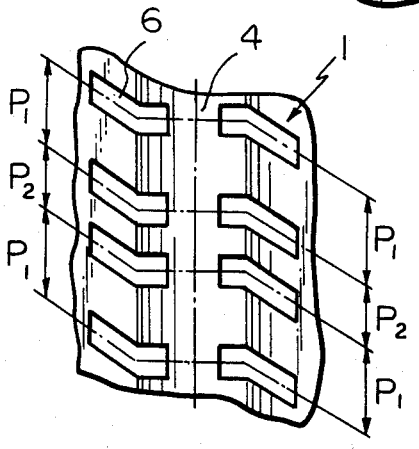
Fig. 33

RECIPROCAL BLADE ASSEMBLY OF ELECTRIC SHAVER

This is a continuation of application Ser. No. 191,518, filed Sept. 29, 1980, now abandoned.

This invention relates to reciprocal blade assemblies of electric shavers and, more particularly, to improvements in reciprocally-driven type electric shaver blade assembly consisting of an outer blade made of a net-like steel foil fixed as bent substantially semicylindrically to the head part of a shaver body and an inner cutter driven to reciprocate in the longitudinal direction of the outer blade with cutting edges of a plurality of semicircular or arcuate blades brought into contact with the inner peripheral surface of the outer blade.

In conventional electric shavers of the kind referred to, the outer blade 1' is, as shown in FIG. 1A, a flat plate-shaped very thin and flexible steel foil provided with many hair inlet apertures in a rectangular zone indicated by a chain line in the drawing substantially in the middle along the longitudinal axis, which is fixed to the head part of the shaver body as bent so that the zone having the hair inlet apertures will be semicylindrical with respect to the longitudinal axis. As shown in FIG. 1B, the inner cutter 2' comprises a plurality of blades respectively having a substantially semicircular cutting edge fitting the semicylindrical inner surface of the bent outer blade, which are integrally joined as mutually spaced so that their edges will form a semicylindrical plane. The cutting edges of this inner cutter 2' are brought into intimate contact with the inner surface of the outer blade and the cutter is driven to reciprocate in the directions of the longitudinal axis of the semicylindrical outer blade 1' within the shaver body. Generally, the user shaves beard hair while moving the shaver in the direction intersecting at right angles the direction of the longitudinal axis of the outer blade. In such case, the hair inlet apertures of the outer blade 1' are provided with various shapes, sizes and angles with respect to the inner cutter sliding direction or shaver moving direction intended so as to be able to catch hair of various lengths and angles but, since the outer blade only has a smooth cylindrical surface, the respective apertures of comparatively small sizes develop substantially flatly and, therefore, long beard hair including the one which is apt to be held between the user's face skin and the exterior surface of the outer blade, the one lying along the skin, the one curled and the like are hard to be introduced into any one of the apertures. Further, even if such a long hair is introduced into the aperture, the hair introduction is to be made within a very short time until a next inner cutter blade arrives after a passing through the aperture of one of the blades of the inner cutter which respectively having an arcuately continuing cutting edge, so that possible introduced and cut length of the long hair extending substantially parallel to the skin surface and hair shearing plane between the inner and outer blades will be also slight or the long hair will not be even cut but rather rejected out of the aperture by the next arriving blade. Therefore, the conventional shavers of the kind referred to have a defect that their shaving effect is low specifically for such long hair which are hard to cut and grow long along the skin.

FIG. 2 shows in section another example of a conventional electric shaver blade assembly having a formation similar to that of the shaver in FIG. 1 in respect that the inner blade having a plurality of cutting edges is driven to reciprocate in the longitudinal directions of the outer blade surrounding the inner blade, which has been suggested in U.S. Pat. No. 3,579,824 of May 25, 1971 (corresponding to British Pat. No. 1,254,137 of May 22, 1969, Australian Pat. No. 452,361 of May 23, 1969 and German Pat. No. 1,927,032 of Oct. 27, 1971). In this case, an outer blade 1'' has a main shaving surface curved with a comparatively large radius in section, side shaving surfaces provided substantially vertically to the main shaving surface on its both sides and bent parts **1*a*'' recessed inward from the main surface to be parallel to the longitudinal axis, respectively intermediately between the longitudinal axis and the respective side shaving surfaces, and is provided to have such cross-section by bending in advance a steel plate having a comparatively higher rigidity than the flexible steel foil in the case of FIG. 1, whereas an inner blade 2'' in this case consists of a pair of movable blades each having a part contacting one of the side shaving surfaces of the outer blade 1'' and one side part of the main shaving surface continued to the particular side shaving part and another part contacting one lateral part of the longitudinal center of the main shaving surface, the both contacting parts of the respective movable blades are connected with each other through a connecting part which is separated inward from the respective bent parts 1*a*'' of the outer blade, the tip of each contacting part is directed inward, and beard hair is cut with the inner cutter 2'' in cooperation with slit-shaped hair inlet apertures provided as extended from the longitudinal center to the respective bent parts 1*a*'' and from the respective bent parts to the respective side shaving surfaces in the outer blade 1''. Therefore, as clear from the drawing, the slip-shaped apertures in this example of conventional shavers extend from the main shaving surface to the both side walls of the bent parts and to the side shaving surfaces, whereby hair inlet openings separating deep in the vertical direction from the main shaving surface or side shaving surfaces and the skin with which these surfaces are contacted are provided and the cutting edges of the inner cutter also have parts separating further inward in these vertical or deep hair inlet openings. The long hairs as described above is caught into such vertical openings to be immediately introduced inside the outer blade long enough without being rejected by the cutting edges of the inner cutter and can be cut. Therefore, the shaver of the conventional formation shown in FIG. 2 is advantageous generally in respect of the effect of shaving the long hair. However, in this type of shaver, as it is necessary to have a comparatively high rigidity in the outer blade, a steel plate thicker than the steel foil in the case of FIG. 1** is used and, therefore, hair is cut by leaving a length of hair corresponding to the thickness of the outer blade. Thus this type shaver can not be said to be always advantageous, in addition to that the area of contact of the cutting edges of the inner cutter with the shaving surfaces of the outer blade is comparatively small, rather in respect of the effect of shaving normal hair existing in a state of easy shaving with smaller lengths.

Here, it may be considered that, if the bent parts **1*a*'' and vertical hair inlet openings in FIG. 2 are applied to the outer blade 1' of FIG. 1 which is advantageous in the normal hair shaving effect because of the very thin steel foil and the cutting edge parts separating inward from the openings in the inner cutter 2'' of FIG. 2 are applied to the inner cutter 2' of FIG. 1**, the shaving effects for beard hair in all kinds of growing state will be improved. However, in the case when the very thin, flexible and flat plate-shaped steel foil is provided with such preliminarily bent parts and fixed to the shaver head as bent to be semicylindrical, the entire flexibility of the foil is divided by the bent parts even though the foil is kept uniform in the thickness, and the substantially true circularity in the cross-section of the bent foil obtained in case there is no bent part can no longer be obtained. Even when the inner cutter having the arcuate cutting edges is contacted with the outer blade having such non-true circular cross-section, the flexible outer blade will be able to fit the shape of the inner cutter but the contact pressure between the inner and outer blades will not be uniform, a friction heat generated when the inner cutter blades slide will become high, non-uniform wear of the cutting edges will be accelerated, an interference between the outer blade and the cutting edges of the inner cutter will be likely to occur and the shaving efficiency will reduce. While these problems will be able to be avoided if an inner cutter having cutting edges adapted to the non-true circular shape in section of the outer blade, an inner cutter having such non-true circular cutting edges must be specially prepared, and a disadvantage occurs in that the manufacturing cost will be higher than in the case of using the inner cutter of the arcuate blades which is adaptable to various flexible foil cutter blades of different aperture designs but used commonly as bent semicylindrically and thus can be manufactured in mass production scale at a low cost. The present invention has been suggested in view of these problems involved in the conventional reciprocating type electric shaver blade assembly.

A primary object of the present invention is, therefore, to provide a reciprocal blade assembly of electric shavers which can positively catch and cut beard hair in all growing states to be short and has a high shaving effect.

Another related object of the present invention is to provide a reciprocal electric shaver blade assembly comprising an outer blade of a very thin flexible steel foil provided has hair inlet apertures including openings deep with respect to the surface and can be smoothly fitted to inner cutter blades having semicircular cutting edges while maintaining a substantially semicircular cross-section with a substantially uniform radius of curvature when bent.

Still another related object of the present invention is to provide a reciprocal electric shaver blade assembly wherein an outer blade of a steel foil having hair inlet apertures including the deep openings can be contacted under a uniform pressure with an inner cutter having semicircular cutting blade edges without changing the inherent thinness of the foil.

Still further related object of the present invention is to provide a reciprocal electric shaver blade assembly wherein an outer blade which has a preliminarily bent part to provide the deep openings and can be uniformly and intimately contacted with the semicircular cutting edges of the inner cutter, can be made of a very thin steel foil, the manufacturing cost is low and still the shaving effect is high.

Yet further object of the present invention is to provide a reciprocal electric shaver blade assembly which is capable of introducing beard hair in all states effectively into the hair inlet apertures to be cut therein and any interference between the cutting edges of the respective outer blade and inner cutter blades can be prevented to maintain a favorable shaving efficiency over a long period.

Other objects and advantages of the present invention shall become clear as the explanation of the invention advances as detailed in the followings with reference to preferred embodiments shown in accompanying drawings, in which:

FIGS. 1A and 1B are perspective views respectively of an outer blade of a very thin steel foil used conventionally in reciprocating type electric shavers and shown in a flat state before being bent to be fixed to shaver body, and of an inner cutter comprising having semicircular cutting blade edges to be combined with this outer blade;

FIG. 2 is a sectioned view showing as coupled to an inner cutter driving means fragmentarily shown of another conventional reciprocating type electric shaver, wherein a blade assembly comprises an outer blade of a comparatively rigid steel plate which is preliminarily formed to be substantially U-shape in section and provided with the openings extending deep from the shaving surface and an inner cutter to be combined with the outer blade;

FIG. 7 is a fragmentary sectioned view as magnified of a bent part of an outer blade of the present invention;

FIG. 8 is a fragmentary sectioned view as magnified of a bent part of another embodiment of an outer blade;

FIGS. 9A to 9C are respectively a fragmentary plan view, sectioned view and further plan view as magnified for explaining the embodiment of FIG. 4, with FIG. 9B being taken along line 1XB—1XB in FIG. 9A;

FIGS. 10A and 10B are respectively a plan view of a general outer blade and a fragmentary side view of a general inner cutter shown schematically for explaining the correlation between the zone having hair inlet apertures of the outer blade and the effective cutting length of the inner cutter;

FIG. 11 is a sectioned view seen on line XI—XI in FIG. 9A;

FIG. 25 is a magnified sectioned view of an essential part showing a gap between the inner cutter and the outer blades of the present invention;

FIGS. 26 to 28 are characteristic diagrams showing generated positions and amounts of a gaps between the outer blade and the inner cutter in engagement with each other;

FIG. 31 is a fragmentary plan view as magnified and similar to FIGS. 29 and 30 for explaining a difference between the pitch of the slit-shaped apertures of the outer blade and internal distance of the inner cutter blades in the present invention;

FIGS. 32A and 32B are respectively a fragmentary plan view and sectioned view as magnified showing an interference between the outer blade and the inner cutter blade occurring in the case when the pitch and internal distance as in FIG. 31 are the same;

FIG. 33 is a fragmentary plan view as magnified of an outer blade of another embodiment of the slit-shaped apertures;

Figure 66B:
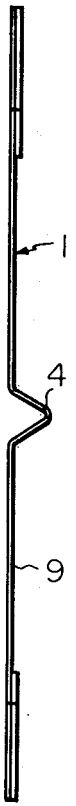
Figure 66A:
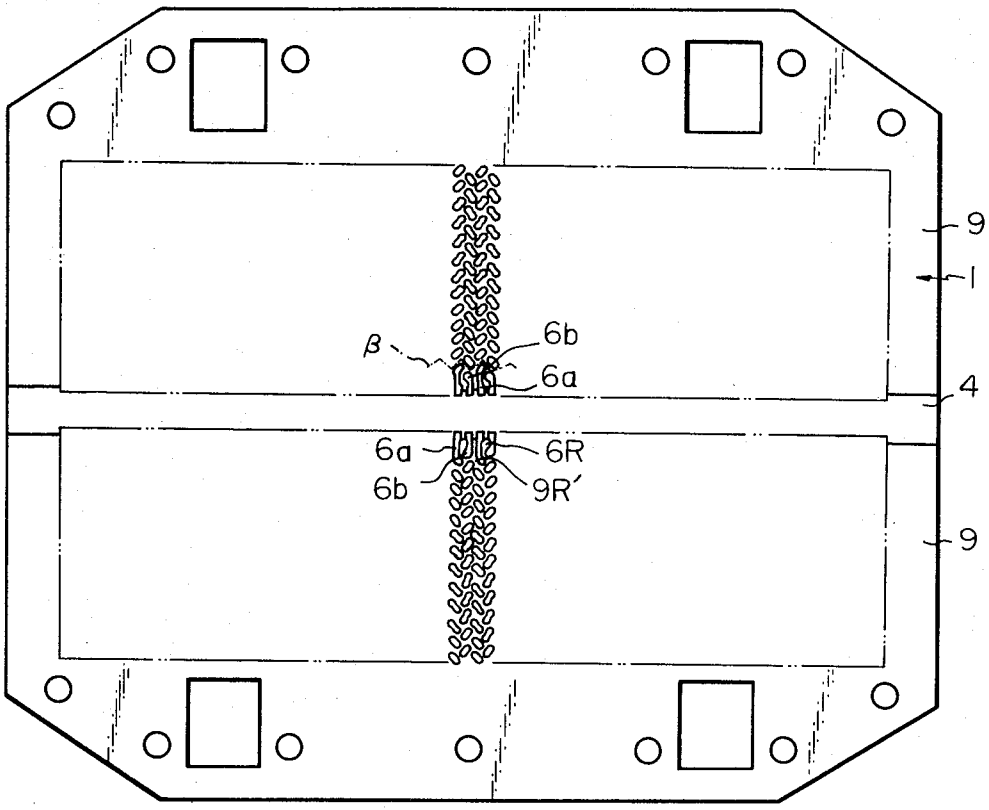
Figure 68B:
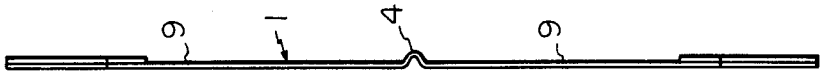
Figure 68A:
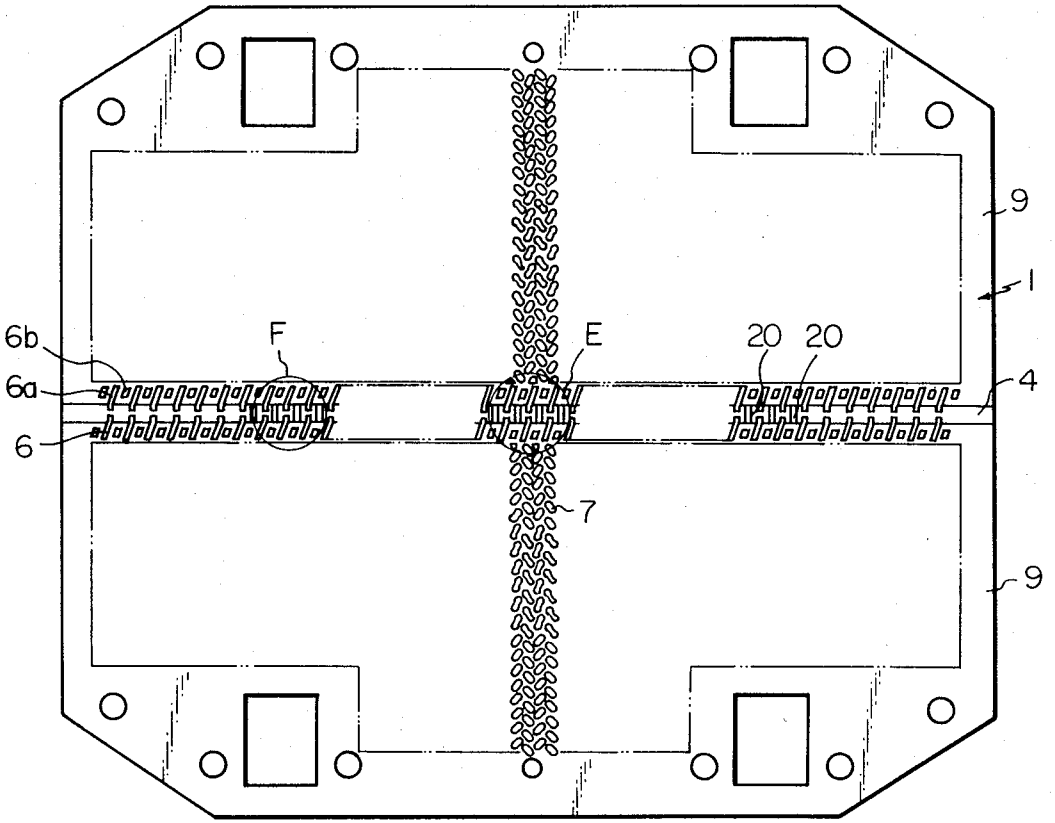
Figure 69:
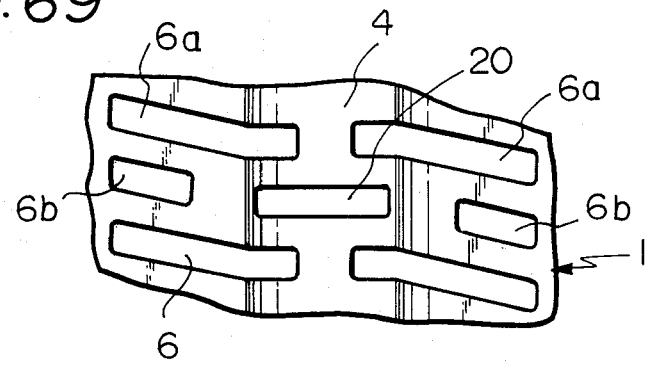
Figure 70:
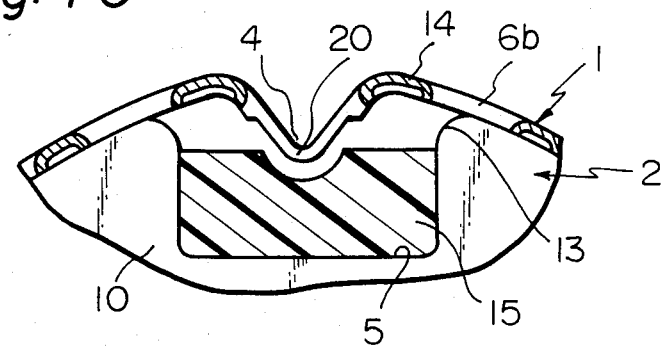
Figure 71:
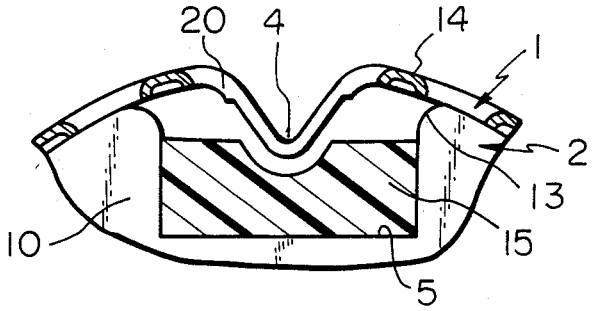
Figure 72:
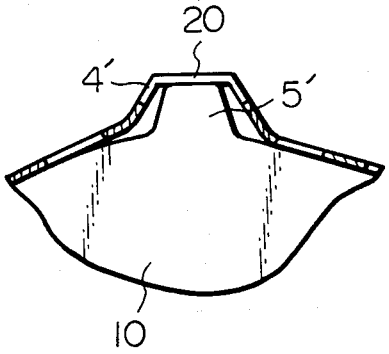
Figure 73:
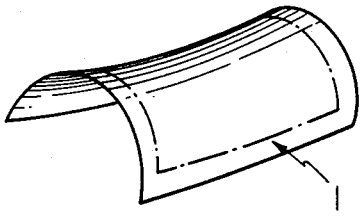
Figure 74:
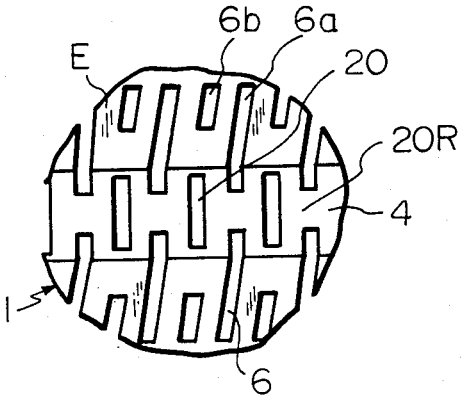
Figure 75:
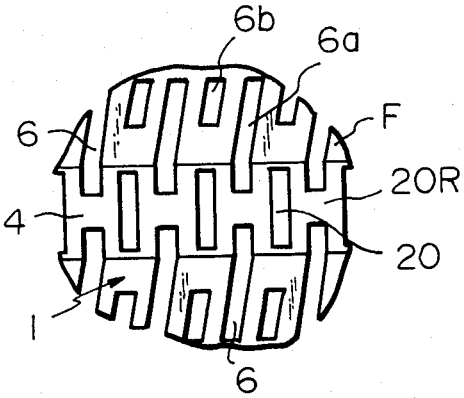
Figure 76:
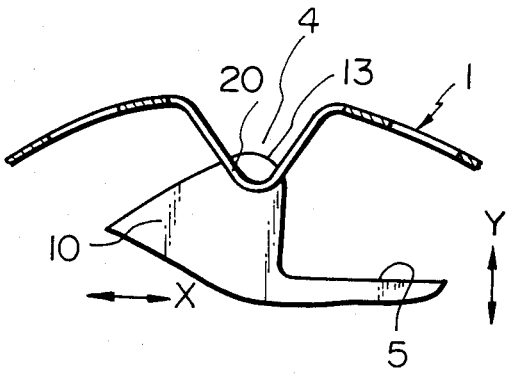
Figure 77:
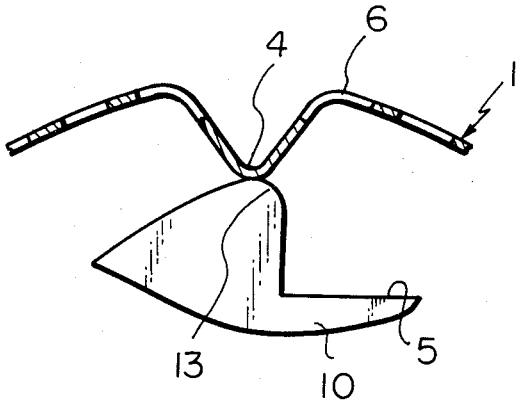

FIGS. 66A, 66B; 67A, 67B and 68A, 68B are respectively a plan view and side view of the outer blades of different embodiments as developed;

FIG. 69 is a fragmentary plan view as magnified of the outer blade of FIG. 68;

FIGS. 70 to 72 are fragmentary sectioned views as magnified of different embodiments of the outer blade and inner cutter blade;

FIG. 73 is a perspective view showing a saddle-like deflection of the outer blade;

FIGS. 74 and 75 are respectively fragmentary plan views as magnified of encircled parts E and F the outer blade of FIG. 68; and FIGS. 76 and 77 are fragmentary sectioned views as magnified of the inner and outer blade particularly respectively showing the interference between them due to sidewise movement of the inner cutter blade and its preventing measure in the present invention.

While the present invention shall now be detailed in the followings with reference to the illustrated embodiments, it shall be appreciated that its intention is not to limit the invention only to these embodiments but rather to include all possible modifications, alterations and equivalent arrangements within the scope of appended claims.

Figure 6:
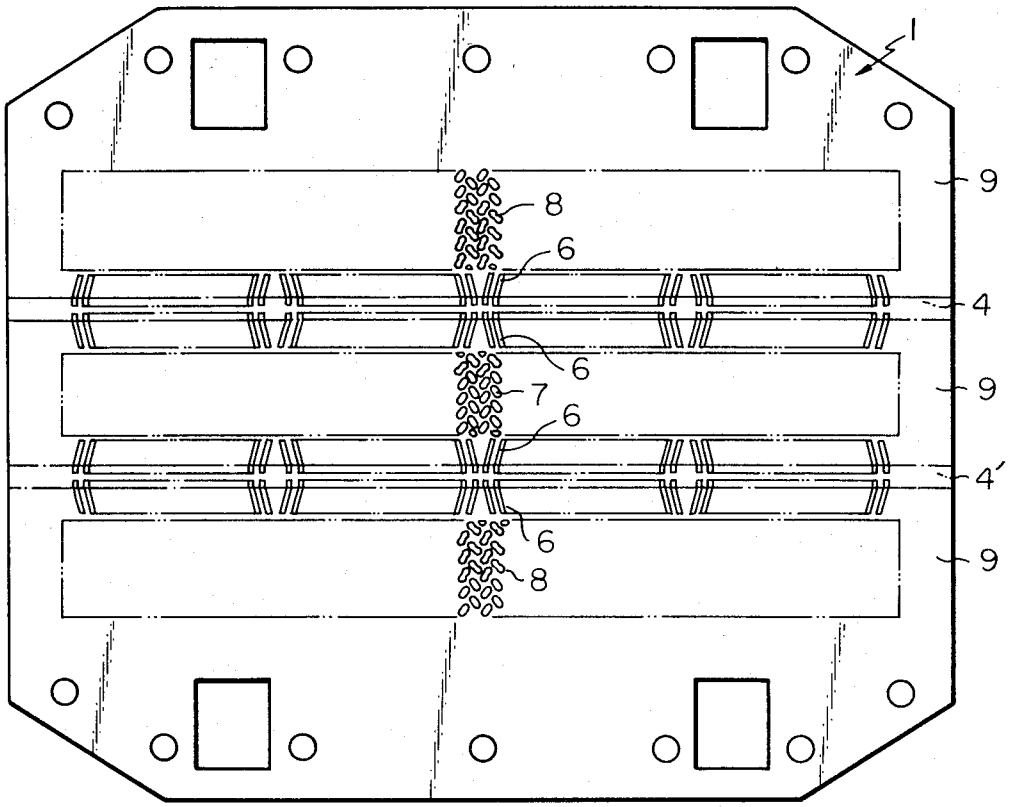
Figure 20B:
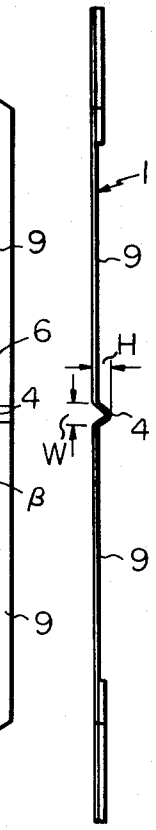
FIGS. 20A and 20B are respectively a plan view and side view of an outer blade as developed for explaining the mode of the present invention in the embodiment of FIG. 4.
Figure 20A:
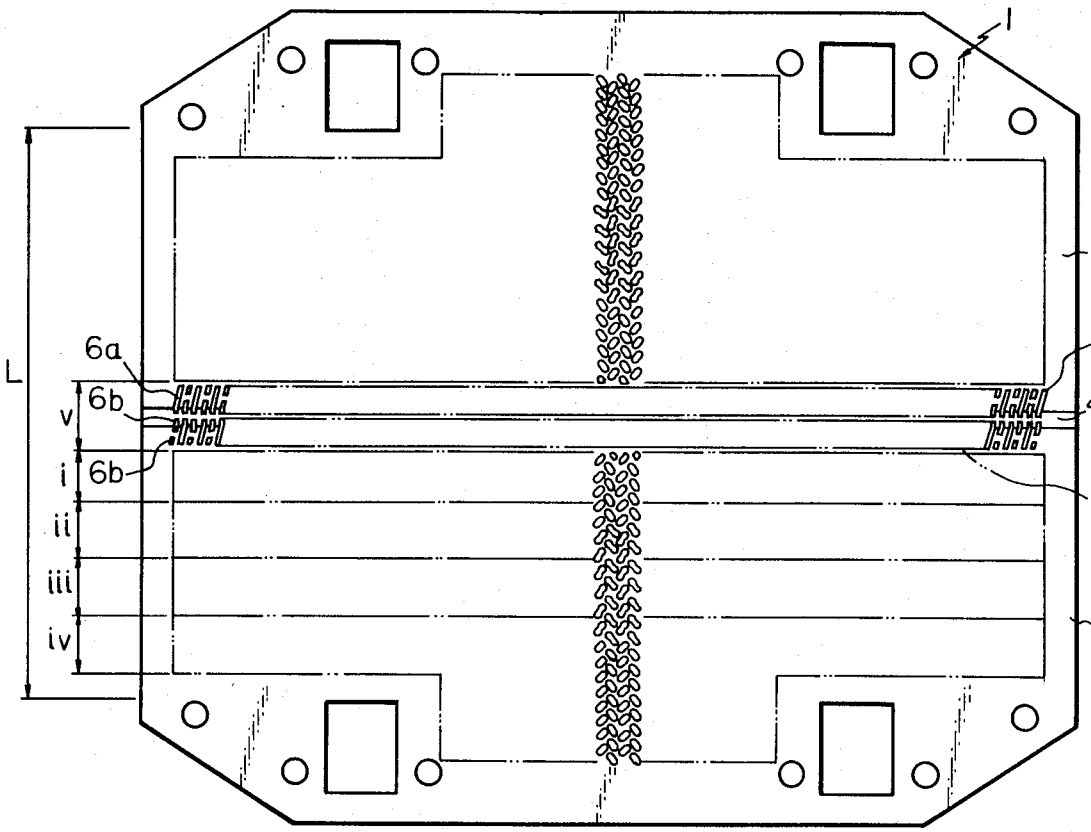
Figure 20C:
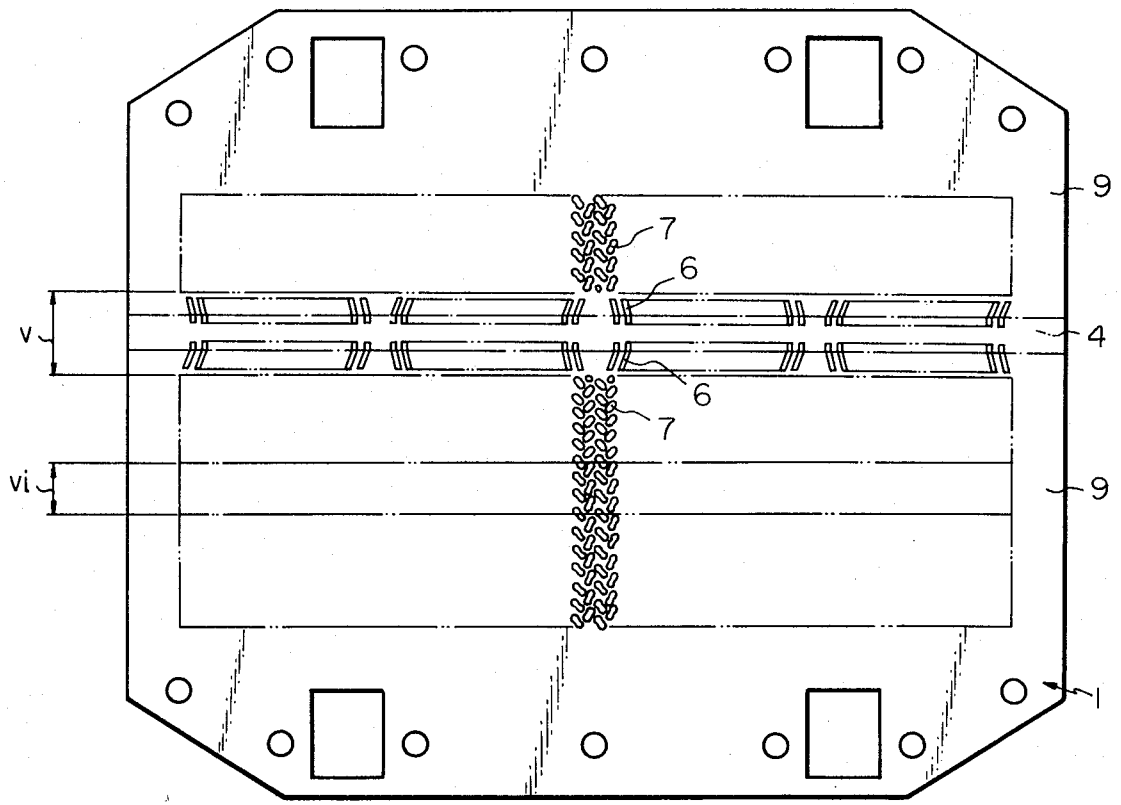
FIG. 20C is a plan view of an outer blade as developed for explaining the mode of the present invention in the embodiment in FIG. 5.
Figure 19:
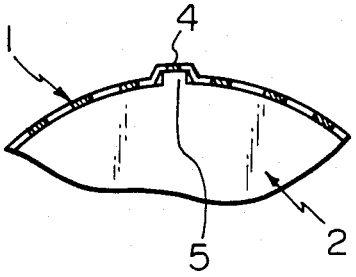
FIG. 19 is a fragmentary sectioned view showing an example of a projected type bent part of the outer blade and a projected undulated part of the inner cutter according to the present invention.

Referring to FIGS. 3 to 6, an outer blade 1 is made of a flat plate-shaped, thin and flexible steel foil, which is fitted to an electric shaver body 3 as bent to be semicylindrical. The outer blade 1 is provided with an elongated bent part 4, which is preliminarily formed in a groove shape over the entire length in parallel with the reciprocating sliding direction of an inner cutter 2. This bent part 4 is shown to be recessed on the side contacted by the inner blade in FIGS. 3 to 6 but it may be projected on the outside to be contacted by the skin of the user's face. A plurality of such bent parts 4 may be provided as shown in FIG. 6. Slit-shaped apertures 6 extending from each side wall of the bent part 4 to a part of flat surface part 9 of the outer blade lying adjacent the side wall are provided as arranged in the reciprocating sliding direction of the inner cutter. It is preferable that, as seen in the drawings, these slit-shaped apertures 6 are provided to extend, within the area of the both side walls 4A/4B of the bent part 4, in the direction intersecting at right angles the inner cutter's reciprocating sliding direction, that is, the longitudinal axis of the outer blade and, within the area of the flat surface part 9, in the direction intersecting diagonally the longitudinal axis. On the other hand, the inner cutter 2 is formed with many blades 10 having respectively an arcuate upper edge and arranged intersecting at right angles the sliding direction. Each of the blades 10 is provided in the arcuate edge with an undulated part 5 in the form of an incision or projection corresponding to the recessed or projected bent part 4 of the outer blade 1 so that, in the case when the bent part 4 is recessed, the corresponding part 5 will be recessed and the recessed bent part 4 will be positioned within the recessed undulated part 5 (FIG. 3 or 19) and, in the case when the bent part 4 is projected, the undulated part 5 will be projected and will be positioned within the projected bent part 4 (FIG. 20). Small holes 7 and slots 8 are provided as hair inlet apertures in the both flat surface parts 9 of the outer blade 1. These small holes 7 and slots 8 are formed respectively as groups extending parallel with the bent part 4. Thus, a group of the slit-shaped apertures 6 is provided in the bent part 4 and respective groups of the small holes 7 and slots 8 are arranged in respective elongated zones-sequentially parallelly defined in the direction intersecting at right angles the longitudinal axis of the outer blade, that is, the reciprocating sliding direction of the inner cutter 2. In the drawings, both holes 7 and slots 8 are shown to be substantially elliptic. In this case, the major axis diameter of the small hole 7 is made smaller than that of the slot 8. Therefore, these holes 7 and 8 may be formed of circular holes different in the diameter but, in either case, the numbers of the holes in the zones of the respective hole groups 7 and 8 are made substantially the same. That is, it is preferable to make the distribution density of the holes substantially the same in the respective zones. Further, the diameters of the holes 7 and 8 are made smaller than the major axis diameter of the slit-shaped aperture 6 of the bent part 4. In the embodiment shown in FIG. 4, the bent part 4 and slit-shaped apertures 6 therein are arranged in the middle in the direction intersecting at right angles the reciprocating sliding direction of the inner cutter 2, the small hole-shaped apertures 7 are arranged on both side zones, the slit-shaped apertures 8 are arranged on further both side zones of them and the small hold-shaped apertures 7 are again arranged in the outermost both side zones of the outer blade 1. In the embodiment shown in FIG. 5, the arrangement is made, sequentially from one side of the outer blade, with the slots 8, bent part 4 at a position deviated from the longitudinal center of the outer blade together with the slit-shaped apertures 6, small holes 7 and again slots 8. In the other embodiment shown in FIG. 6, the small holes 7 are arranged in the middle, a pair of the bent parts 4 together with the slit-shaped apertures 6 are arranged on both sides of the zone of the holes 7, and the slots 8 are arranged on further both sides of these bent parts 4.

Each of these slit-shaped apertures 6, small holes 7 and slots 8 is formed by giving a recess having the shape of each hole deeper than the plate thickness (blank material thickness) from one surface to a flat plate-shaped steel foil and then grinding and cutting the bottom surface of the recess on the other surface side of the foil to render the projected peripheral edge of each hole to be the cutting edge, so that ribs between the respective slit-shaped apertures 6, small holes 7 and slots 8 will be substantially U-shaped in section as shown in FIG. 7 or 11.

Figure 15:
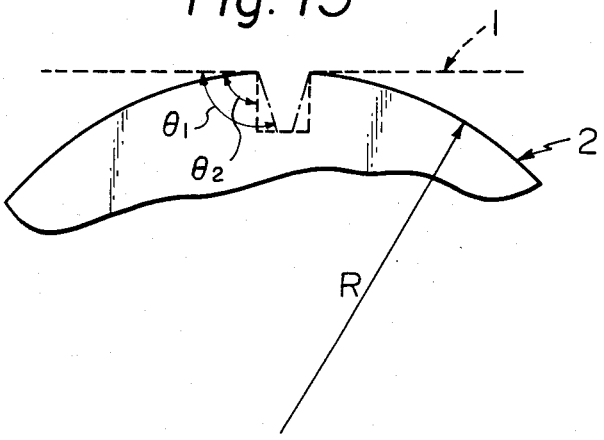
FIGS. 15 to 18 are operation explaining views showing influences of differences in the angle formed by a preliminary bent part and flat surface part of the outer blade of the present invention.
Figure 16:
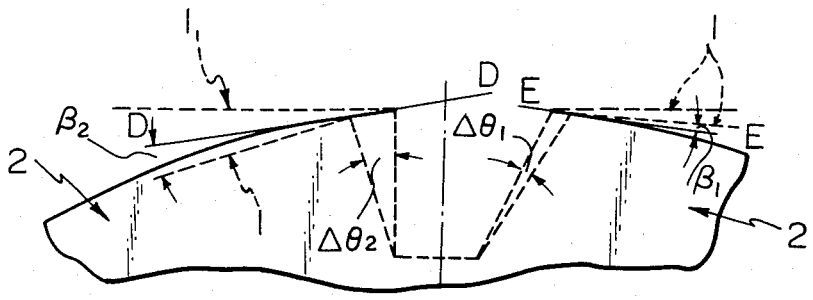
Figure 17:
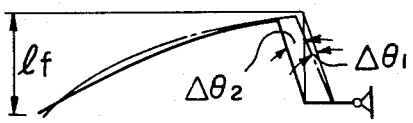
Figure 18:
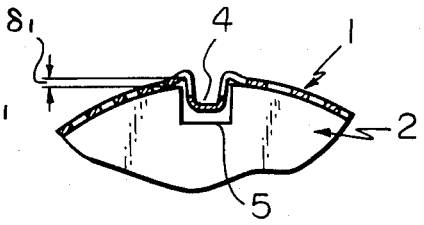

In the practical use, the reciprocating type electric shaver is normally moved on the face skin in the direction intersecting at right angles the sliding direction of the inner cutter. Therefore, when one point of the skin is considered, it will be found that the part of the outer blade 1 contacting the point will move in the direction intersecting at right angles the sliding direction of the inner cutter blades. That is, the point moves from the slots 8 through the small holes 7 to the slit-shaped apertures 6. The small holes 7 will not be able to catch and cut the long hair but will catch and cut short hair and the ones which have not been caught and cut to be short in the slots 8 and slit-shaped apertures 6. In the slots 8, the long hair which has been unable to be introduced into the small holes 7 will be introduced and cut. In the case when, for example, the bent part 4 is recessed, such bent part 4 is effective in expanding a part of the face skin into the recess of the bent part 4 so as to raise any long hair lying along the skin at the particular skin part and introduce the raised long hair into the slit-shaped aperture 6 as seen in FIG. 11, which shows that, when the shaver is moved in the direction intersecting at right angles the longitudinal axis of the outer blade along the face skin, the long hair 11 will move in turn from the right side to the left side in the drawing and will be finally cut by one of the inner cutter blades 10. Here, the slit-shaped apertures 6 are inclined in their longitudinal axis with respect to the bent part 4 while the apertures reside in the flat surface part 9 so as to provide a hair holding angle with the inner cutter blades 10 which are disposed perpendicularly to the longitudinal axis of the outer blade, to improve the cutting efficiency and to prevent the interference of the inner cutter blades 10 with the outer blade 1 in the slit-shaped apertures 6. It is preferable, in securing the intimate edgewise contact of the inner cutter blades 10 with the inner surface of the outer blade 1, to make the angle $\theta$ formed by the flat surface part 9 with the side wall of the bent part 4 to be an obtuse angle, as shown in FIG. 7. That is, in comparing the case where this angle $\theta$ is an obtuse angle $\theta_1$ larger than 90 degrees and the case where it is a right angle $\theta_2$ with each other, as shown in FIGS. 15 to 17, it is found that, if a displacement $l_f$ for bending the outer blade to be semicylindrical is taken, to be the same, an angle variation $\Delta\theta_2$ will be larger than $\Delta\theta_1$. In case the inner cutter blade 10 having the arcuate edge or a radius R is contacted with the outer blade 1 bent with the displacement $l_f$, the difference between the angles formed with the tangents D—D and E—E of the inner cutter blade 10, that is, the contact angle difference $\beta$ will be such that a value $\beta_1$ in the case of the obtuse angle $\theta_1$ will be smaller than a value $\beta_2$ in the case of the right angle $\theta_2$. The larger the value of the contact angle difference $\beta$, the more likely is a gap $\delta_1$ to be generated adjacent the bent part 4 as shown in FIG. 18. Therefore, with the obtuse angle which reducing the contact angle difference $\beta$, the intimate contact of the inner cutter blades 10 with the outer blade 1 can be secured. Further, in the case of forming the bent part 4 to be recessed, it is preferable that the bottom part 12 where no slit-shaped aperture 6 is provided will be made to be an upward projection of a substantially triangular section as shown in FIG. 8, in which case, as compared with the case shown in FIG. 11, the contact angle of an edge **12*a* of the bottom part 12 with hair 11 will become smaller, the slide between them will improve, a pulling action against hair 11 of the edge can be prevented and hair will be shaven with a more favorable skin touch. Further, there will be an advantage that cut and waste hair will not be accumulated on the bottom part 12 in the bent part 4. It is also preferable to coat the surface of the bottom part 12** with an ethylene fluoride resin.

Figure 4B:
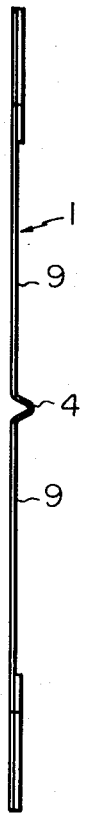
FIGS. 4A and 4B are respectively a magnified plan and side view of the outer blade of FIG. 3A.
Figure 4A:
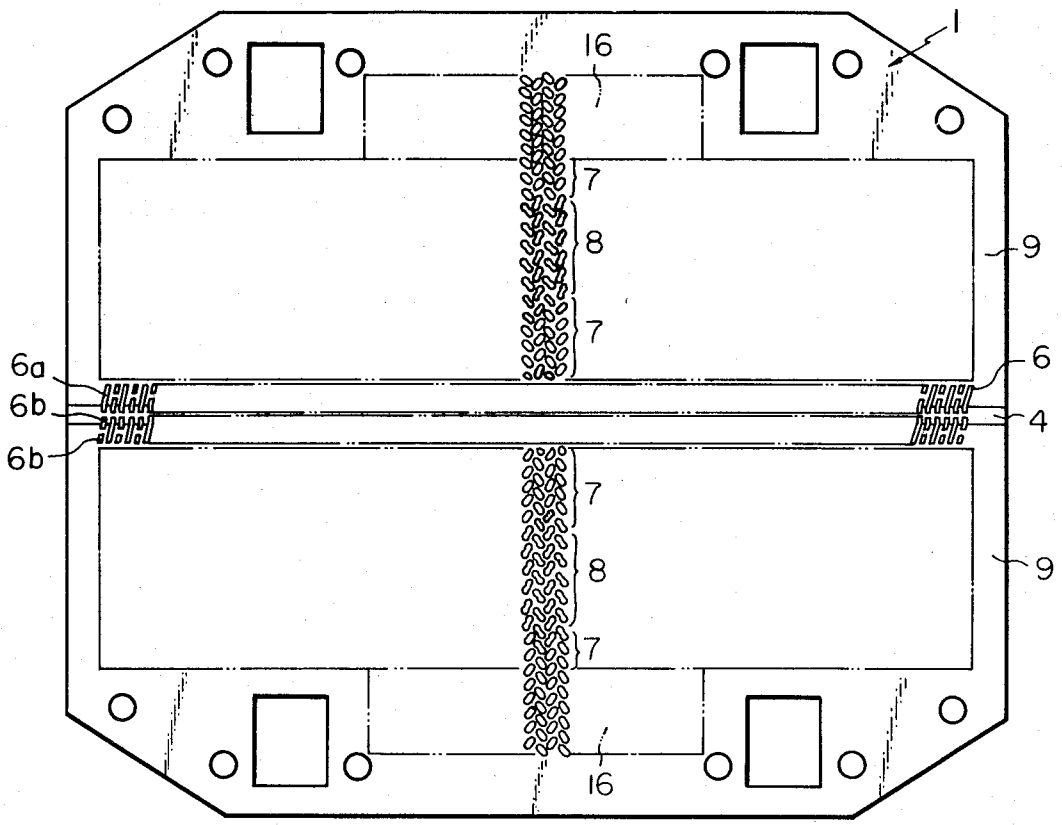
Figure 5:
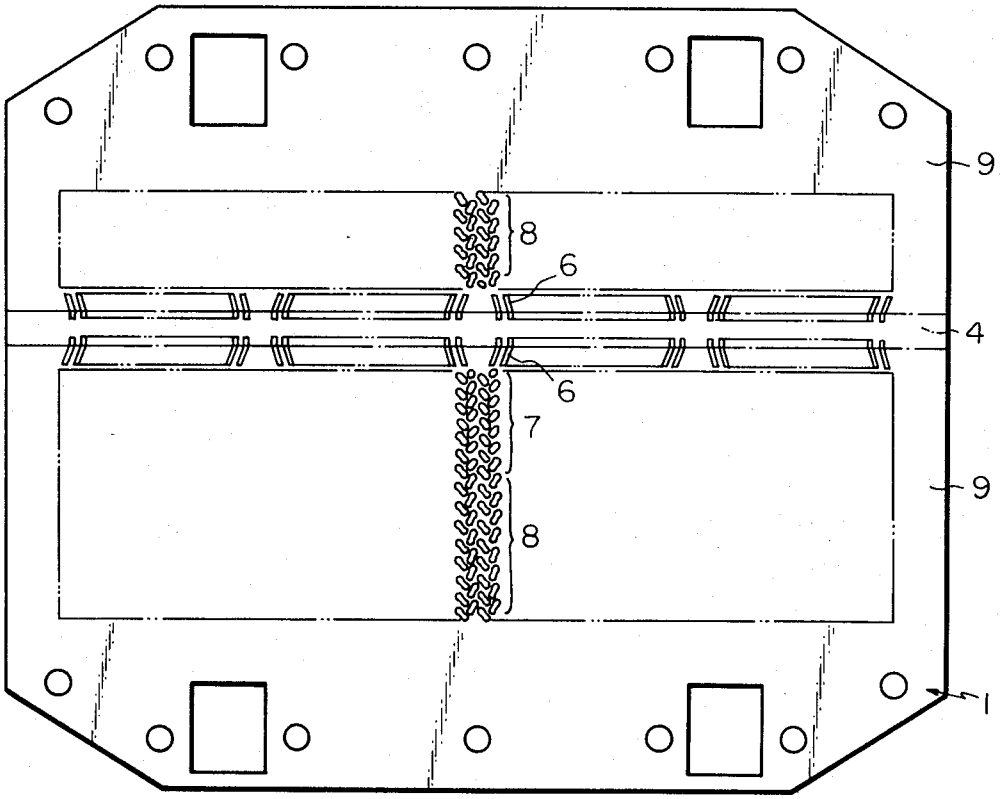
FIGS. 5 and 6 are respectively a plan view showing each of other embodiments of the outer blades according to the present invention.

In the embodiment shown in FIG. 4, the slit-shaped apertures 6 are formed of two kinds of long slit-shaped apertures **6*a* and short slit-shaped apertures 6*b*, two of the latter of which sequentially extending in the direction intersecting substantially at right angles the reciprocating direction of the inner cutter 2 and parallel with the long slit-shaped apertures 6***a*, and the single long slit-shaped apertures 6*a* and two sequential short slit-shaped apertures 6*b* are arranged alternately in the reciprocating direction of the inner cutter 2. As shown in FIG. 9B, respective edge part 13 of the incision 5 of the inner cutter blade 10 are positioned adjacent ribs 14 between the two short slit-shaped apertures 6*b* so as to slide in contact with this part in order to reduce the frequency of the interference of the inner cutter blade 10 with the outer blade 1 and to improve the strength of the outer blade 1 against the interference. The edge parts 13 are made circular with a radius of about 0.2 to 0.5 mm., as illustrated. By this circular edge, the interference of the inner cutter blade 10 with the outer blade 1 will be eliminated and any smarting with pain by hurting the skin with the edge part 13 through the slit-shaped aperture 6 will be well prevented. As clear from FIG. 9A, positions of both ends of the long slit-shaped apertures 6*a* and short slit-shaped apertures 6*b* arranged alternately over the length of the bent part 4 are deviated from each other by half a pitch in the longitudinal direction of the outer blade on both sides of the bent part 4 so that, though the short slit-shaped apertures 6*b* are provided for the reason of providing such ribs 14 as described above, even if the shaver is moved in either of the reciprocating directions of the inner cutter and the directions intersecting the same at right angles, the long hair 11 will be positively introduced and cut in such long slit-shaped apertures 6*a*, as shown in FIG. 11. In the illustrated embodiment, further, the both end positions of the apertures 6*a* and 6*b* are shown as deviated by half a pitch. Instead, so long as the long slit-shaped apertures 6*a* are not opposed to each other and the short slit-shaped apertures 6*b* are not opposed to each other on both sides of the bent part 4, the same effect as that of the half pitch deviation can be obtained. Further, in the case of alternately arranging the long slit-shaped apertures 6*a* and two sequential short slit-shaped apertures 6*b*, as shown in FIG. 9C, respective distances $B_1$ and $B_2$ between the short slit-shaped aperture 6*b* and the adjacent both long slit-shaped apertures 6*b* may be such that the distance $B_1$ will be longer than the other distance $B_2$ in the correlation of the inclining direction of these slit-shaped apertures 6 with respect to the extending direction of the bent part 4. Now, in FIG. 9C and when the inner cutter 2 slides in the direction "i", the long hair 11 is caused to only slide in a zone "a" in the long slit-shaped aperture 6*a* and also in a zone "b" in the short slit-shaped aperture 6*b* and, when the inner cutter 2 moves in the direction "ii", in the long slit-shaped aperture 6*a*, the long hair 11 is also caused to slide, but is cut only in a zone "c" in the short slit-shaped aperture 6*b* with a high probability. On the other hand, as the efficiency of introducing the long hair 11 is far higher in the long slit-shaped aperture 6*a* than in the short slit-shaped aperture 6*b*, when the long hair 11 is cut, a hair cutting load will be larger in the zones "a" and "c", that is, in the distances $B_1$ than in the zone "b", that is, in the distance $B_2$. Therefore, when the distance $B_1$ is made larger than the distance $B_2$, the strength will be able to balanced, the dynamic strength of the outer blade 1 will be improved and the hair inlet opening rate will be also improved.

Figure 13:
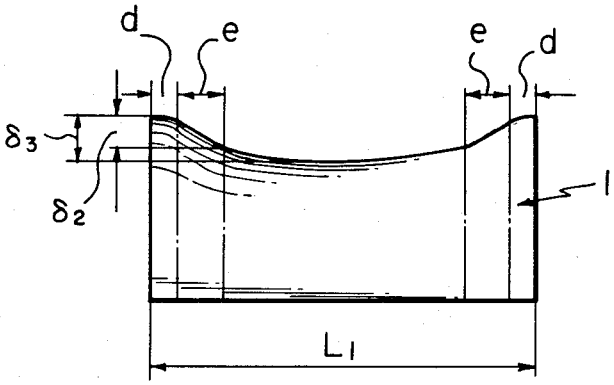
FIGS. 13 and 14 are characteristic diagrams of the saddle-like deflection.

Now, the outer blade 1 which is rectangular has generally a nature that, when it is bent to be semicylindrical, it will be likely to be deflected along the longitudinal center so as to be saddle-shaped. This is mostly because the apertures are not provided over the entire length or surface of the rectangular outer blade 1 but are provided leaving the peripheral edges, whereby the bending rigidity in both longitudinal end parts of the outer blade, that is, in the reciprocating directions of the inner cutter 2 is large and these end parts and the zone in which the apertures are provided are substantially not continuous. It is also because the bent part 4 is provided over the entire length of the longitudinal axis of the outer blade. Such saddle-shaped deflection will prevent contacting pressure of the inner cutter 2 with the outer blade 1 from being kept constant. According to data taken by actually measuring such saddle-shaped deflection, as shown in FIG. 13, there is already a deflection $\delta_2$ of 20 microns in a zone "e" for a distance of about 1.5 mm. in the region having the apertures from both longitudinal edge parts "d" in which no aperture is provided. On the other hand, only a deflection $\delta_2$ of 30 microns is generated in the central area as a whole. Therefore, if the total length $L_p$ of the aperture zone of the outer blade 1 is determined to be not less than 1.5 mm. longer respectively from both longitudinal ends of the outer blade in the reciprocating direction of the inner cutter 2 than the effective cutting blade length $L_o$ in the reciprocating range of the inner blade, that is, in the reciprocating stroke of the inner cutter as shown in FIGS. 10A and 10B, that is, if $$(L_p - L_o)/2 = L_2$$

where $$L_2 \geqq 1.5 \text{ mm.},$$

the deflection of the outer blade 1 in the part $L_o$ in contact with the inner cutter 2 will be stabilized, the deflection degree will be small and, therefore, the intimate contact of the inner cutter 2 with the outer blade 1 can be easily secured. In FIG. 13, the total length $L_1$ of the outer blade 1 in the reciprocating direction of the inner cutter is 47 mm. In the drawing, $L_4$ denotes the total length and $L_3$ denotes the amplitude of the inner cutter.

Figure 12:
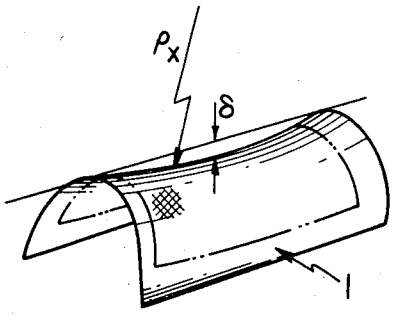
FIG. 12 is a perspective view schematically showing a saddle-like deflection of the general outer blade.
Figure 14:
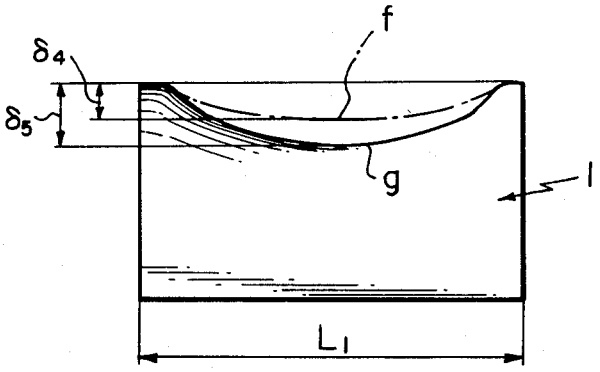

It is effective to provide such means as in the followings as a compensation for the saddle-shaped deflection of the outer blade. As shown in the embodiment of FIG. 4, an additional group of apertures 16 is provided also in respective lateral end parts which are middle parts in the reciprocating directions of the inner cutter 2, in the direction intersecting vertically the longitudinal axis of the outer blade, so that the degree of the saddle-shaped deflection of the outer blade 1 can be made small. The curvature $\rho_X$ of the saddle-shaped deflection $\delta$ shown in FIG. 12 can be approximately represented by $$1/\rho_X = 12UM/Eh^3$$

where U denotes a Poisson's ratio of the outer blade in the aperture zone, M denotes a bending movement, E denotes a Young's modulus and h denotes a plate thickness. When the additional aperture groups 16 are provided, there will be effects of particularly increasing the bending moment M in both lateral end parts of the outer blade 1 in its longitudinal axis, thereby increasing the curvature $\rho_X$ and reducing the saddle-shaped deflection $\delta$. The actually measured valves of the deflection degrees in the case that in additional aperture groups 16 are provided and in the case that they are not provided in the embodiment of FIG. 4 are shown in FIG. 14. The total length $L_1$ was 47 mm., the deflection $\delta_4$ was 20 microns and the deflection $\delta_5$ was 30 microns.

Figure 29:
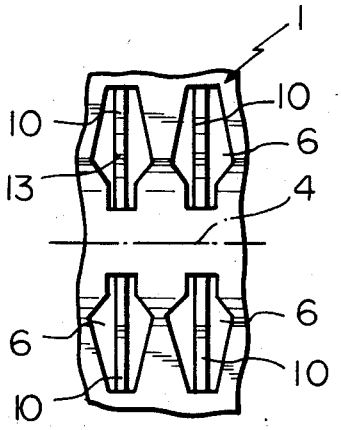
FIGS. 29 and 30 are fragmentary plan views as magnified of an outer blade and inner cutter engaging with the blade for showing further examples of slit-shaped apertures in the outer blade.
Figure 30:
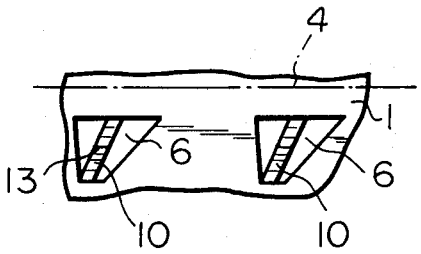
Figure 34:
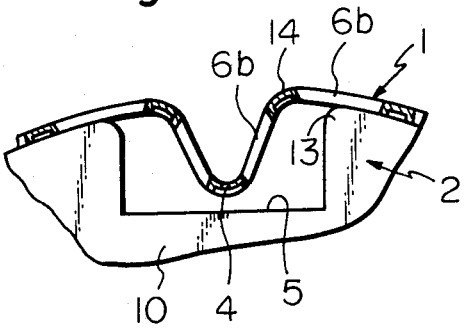
FIG. 34 is a fragmentary sectioned view of another embodiment of the outer blade having reinforcing ribs.

As has been described, the slit-shaped apertures 6 are inclined to the bent part 4 in the flat surface part 9 so that the inner cutter blades 10 will have a hair holding angle, the cutting efficiency will be improved and the interference of the inner cutter 2 with the outer blade 1 will be prevented. In respect of preventing the interference, as shown in FIG. 29 or 30, the slit-shaped apertures 6 may be made in a spade-shape or trapezoid and opening edges on both sides may be inclined with respect to the reciprocating direction of the inner cutter 2 so that the opening width of the slit-shaped aperture 6 will be wider toward the bent part 4. Particularly, FIG. 30 shows an example that, in case the inner cutter blades 10 are provided at another angle than the right angle to the reciprocating direction, the center line of the trapezoid slit-shaped aperture 6 will be also inclined in confirmity with the angle of the blade 10. As each of the blade 10 has positive holding angles with respect to the opening edges on both sides of the slit-shaped aperture 6, at the time of each reciprocating operation, the long hair 11 will be cut and, even at the time of either operation, the edges 13 which is the opening edge of the corresponding part 5 of the blade 10 will not catch on the opening edge of the slit-shaped aperture 6 and the interference of the inner cutter 2 with the outer blade 1 can be prevented. In respect of the interference prevention, further, as shown in FIG. 31, the pitch $P_1$ of the slit-shaped apertures 6 may be made larger than the internal distance B between the inner cutter blades 10. When the pitch $P_1$ and internal distance B are the same and the outer blade 1 is pressed against the face skin, as shown in FIGS. 32A and 32B, the edges 13 of the blade 10 will be likely to fall into the slit-shaped aperture 6 to cause an interference but, when the pitch $P_1$ is made larger than the internal distance B and even when the edges 13 of the blade 10 are just below the slit-shaped aperture 6, the edge 13 of the adjacent blade 10 will be in contact with the lower surface of a rib 6R between the adjacent slit-shaped apertures 6 in the longitudinal direction of the outer blade, the fall of the edges 13 of the blade 10 into the slit-shaped aperture 6 will be prevented by the adjacent blade 10 and, as a result, the interference of the inner cutter 2 with the outer blade 1 will be effectively prevented. As shown in FIG. 33, when the slit-shaped apertures 6 are provided at two kinds of pitches $P_1$ and $P_2$, the internal distance of the respective blades 10 of the inner cutter 2 will be made smaller than the small pitch $P_2$.

Figure 43:
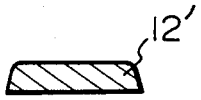
FIGS. 43 and 44 are sectioned views of the outer blade respectively seen on lines C—C and D—D in FIG. 42.

As described above with reference to FIGS. 9A and 9B, it is preferable that, against the interference by the deflection of the rib 6R caused by the length of the rib 6R between the slit-shaped apertures 6, a reinforcing rib 14 is provided so that both edges 13 of the corresponding incision 5 of the blade 10 will contact this reinforcing rib 14. However, in order to improve the strength of the rib, as shown in FIG. 43, it is preferable that the reinforcing rib 14 is positioned in the boundary part of the bent part with the flat surface part 9.

Figure 35:
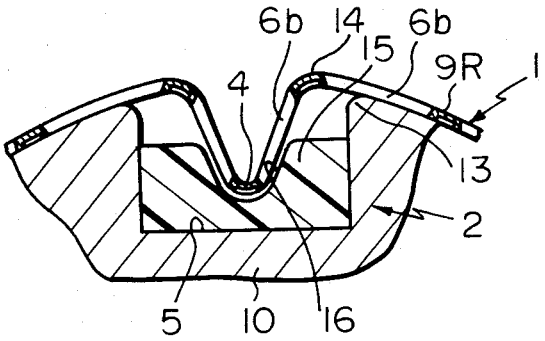
FIGS. 35 to 37 are sectioned views of essential parts of embodiments provided respectively with a regulator for the interference between the inner and outer blades.
Figure 36:
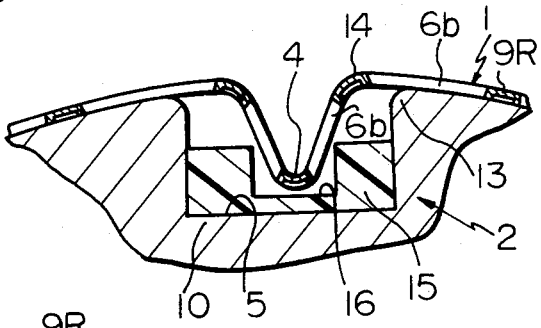
Figure 37:
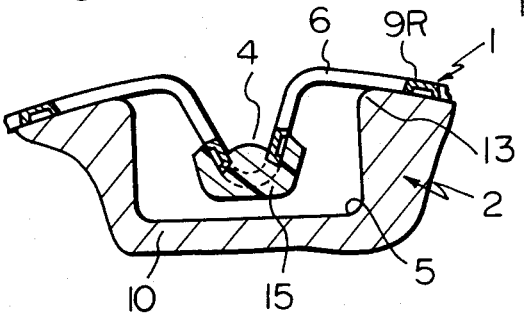
Figure 38:
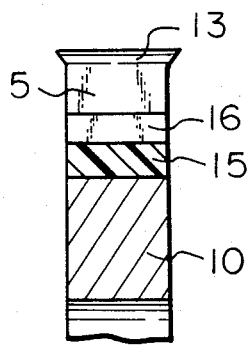
FIGS. 38 to 40 are fragmentary sectioned views as magnified of the inner cutter blade or blades of different embodiments respectively provided with the regulator.
Figure 39:
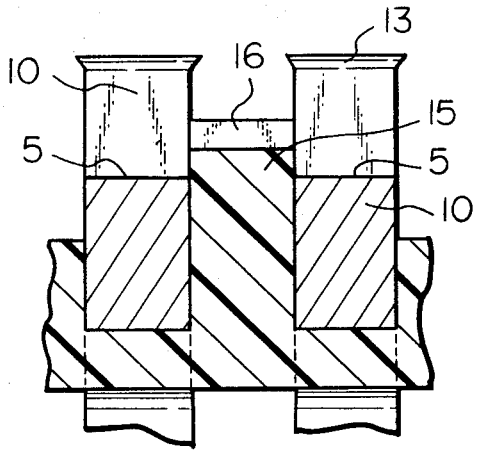
Figure 40:
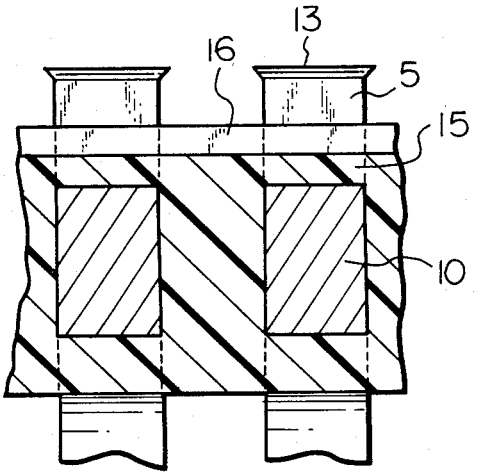
Figure 41:
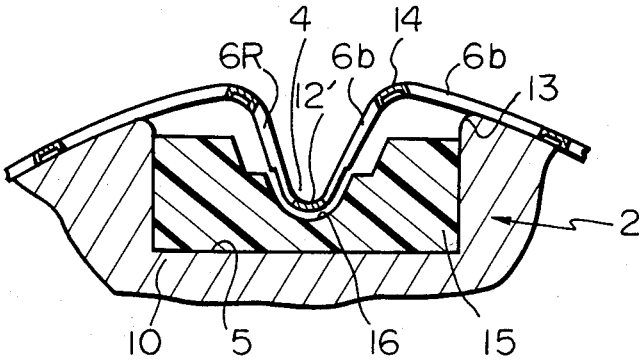
FIG. 41 is a sectioned view of an essential part of still another embodiment of the regulator.
Figure 42:
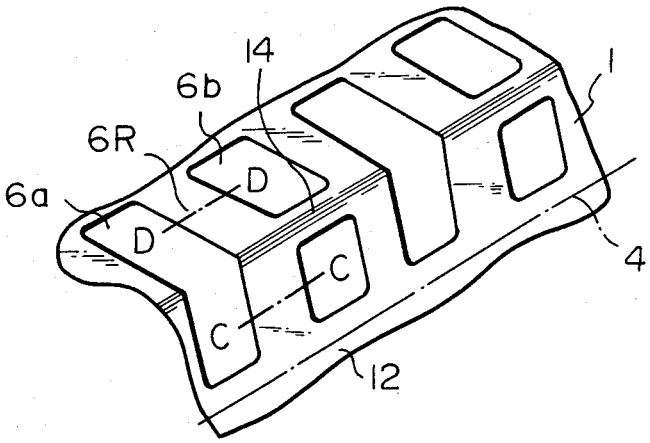
FIG. 42 is a plan view of a part of the outer blade of FIG. 41.
Figure 44:
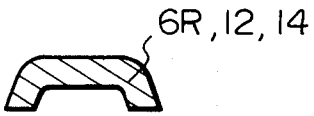

As another measure of preventing the interference between the inner and outer blades on the periphery of the bent part 4, a regulator 15 may be provided in the bent part 4 of the outer blade, or in the undulated edge part 5 of the inner cutter blade 10. FIG. 35 shows an example where the regulator 15 having a receiving groove 16 is fitted in the undulated edge part 5 of the inner cutter blade 10 so that this receiving groove 16 will keep a slight distance from the outer surface of the bottom part of the bent part 4. In such case, even if the outer blade 1 is strongly pressed against the face skin, the edges 13 of the blade 10 will be prevented from falling into the slit-shaped aperture 6 by the contact of the bent part 4 with the regulator 15, and the interference can be well prevented. It is preferable that, in the case of the embodiment of FIG. 36, the contact of the bent part 4 of the outer blade with the regulator 15 will be linear in the edge part of the receiving groove 16 and therefore the sliding resistance will be small. FIG. 37 is of an example that the regulator 15 is fitted to the bottom part of the bent part 4 of the outer blade 1. The regulator 15 may be formed of a metal or, preferably, a synthetic resin and may be fitted by being molded integrally with the inner cutter blades 10 or the bent part 4 of the outer blade. In the case of fitting the regulator 15 to the undulated edge part 5 of the inner cutter blade 10, it may be fitted in the undulated edge part 5 of each blade 10 as shown in FIG. 38, between the respective blades 10 as shown in FIG. 39, or over the entire length of the inner cutter 2 as shown in FIG. 40. However, if the regulators 15 are provided on all of the blades 10, the sliding resistance between the regulators 15 and the outer blade 1 will increase, the driving load of the inner cutter 2 will increase and further the vibration, noise and heat generation of the outer blade will increase. Therefore, in order to prevent them, it is preferable to provide the regulators 15 at intervals of one, two or more of the inner cutter blades 10 instead of on the respective blades. Further, the outer blade 1 should contact the regulator on the surface instead of at a point. However, in the case of providing the regulators 15 on the inner cutter 2, the lower surface of the rib in the bottom part 12' of the bent part 4 is further ground and cut as shown in FIGS. 41 and 43 so that both leg parts of such U-shaped cross-section as in FIG. 44 in the cutting edges of the slit-shaped apertures 6 and other apertures 7 and 8 are also scraped off, the receiving groove 16 in the regulator 15 is made to be of two steps and the gap between the bottom part of the bent part 4 and the regulator 15 is made smaller than the gap between the upper part of the side wall of the bent part 4 and the regulator 15, then the following advantages will be obtained. That is, the side edges of the slit-shaped apertures 6*a* and 6*b* to be cutting edges in the outer blade 1 will be removed in the bottom part 12' of the bent part 4 and, therefore, in case the outer blade 1 is pressed strongly against the face skin, the bottom part 12' of the bent part 4 which is the part of the small gap will first contact the regulator 15 but, at this time, the bottom part 12' will not scrape off the regulator 15 and the wear of the regulator 15 and the interference of the outer blade 1 with the inner cutter 2 caused by the reduction of the regulated amount of the outer blade 1 with the wear of the regulator 15 will be able to be prevented. In this case, too, the bottom of the bent part 4 will not contribute to the hair cutting and, therefore, the removal of the cutting edges of the outer blade in this part will not influence the hair cutting.

Figure 45:
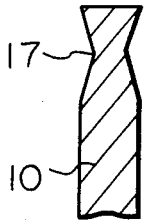
FIG. 45 is a fragmentary sectioned view as magnified of a blade of the inner cutter for showing its undercuts.
Figure 46:
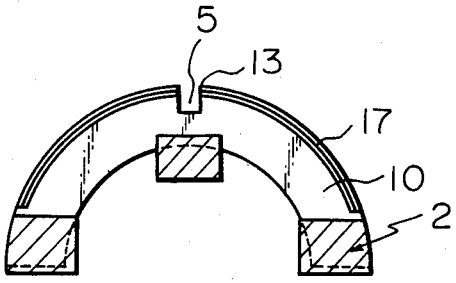
FIGS. 46 and 47 are elevations of the inner cutter blade having the undercuts in different embodiments.
Figure 47:
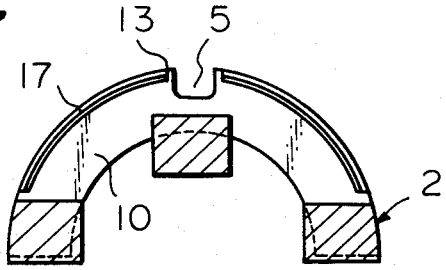
Figure 48:
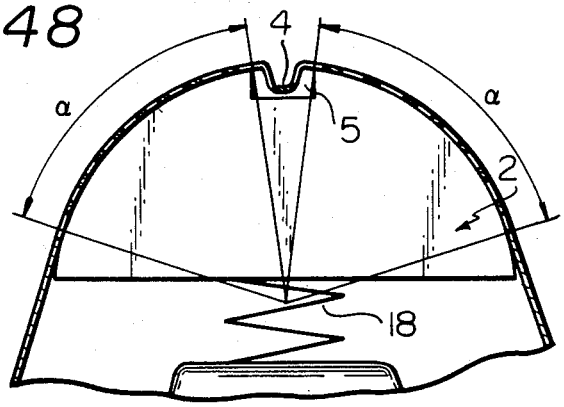
FIG. 48 is a schematic sectioned view showing an effective cutting zone of the blade assembly in the present invention.

On the other hand, in the inner cutter 2, it is preferable for improving the cutting efficiency to form both side edges of the respective blades 10 to be of an acute angle by providing undercut parts 17 on both side surfaces along the cutting edge as shown in FIG. 45. However, if such acute edge is present as continued to the edges 13 of the undulated part 5 as shown in FIG. 46, the frequency of the interference with the outer blade 1 will increase particularly at the edges 13. Further, by these undercut parts 17, the thickness of the blade 10 is made partly smaller than that of the other flat surface part and, therefore, a probability of breakage of the blade 10 at the time of an occurrence of the interference becomes high. Further, when the blade 10 is prepared as subjected to a blanking work or the like, either side surface of the blade 10 is brought into contact with a trimming die, the undercut part 17 in the particular surface provides a gap between the blade and die and, when the blade is blanked or punched out of a material plate, such gap will cause the blade to be deformed at peripheral edge of the undulated part 5. For these reasons, the acute edge by means of the undercut part 17 should preferably be not formed over the entire length of the arcuate cutting edge, leaving both end parts adjacent the edges 13 to be flat, as shown in FIG. 47. That is, even within the effective cutting zones $\alpha$ as in FIG. 48 which can be used to cut hair in sliding contact with the aperture zone of the outer blade 1 in which the hair inlet apertures are present, the acute angled cutting edge by means of the undercut parts 17 is preferably not provided in the parts adjacent the both end parts and edges 13. Such partial cutting edge in which no undercut part 17 is present is still effective to cut hair while the sharpness is not so high as the acute cutting edge having the undercut parts 17. While a favorable cutting efficiency of the blades 10 of the inner cutter 2 is thus obtained by providing such undercut parts 17, the strength of the blade 10 at the undulated part 5 and both end parts can be retained and a desired working precision in preparing the blades including less deformation will improve because of no provision of the undercut adjacent respective such parts.

Figure 1A:
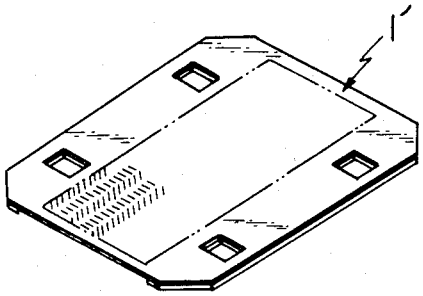
Figure 1B:
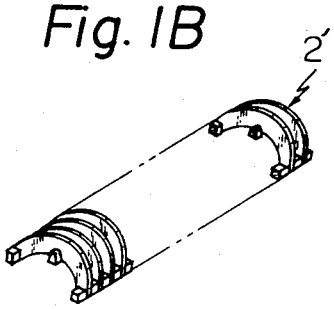
Figure 2:
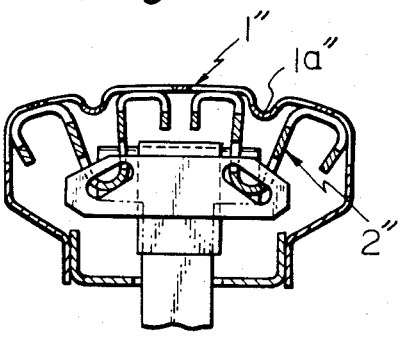
Figure 3A:
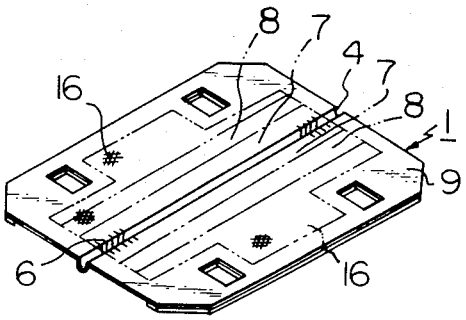
FIGS. 3A and 3B are perspective views respectively showing an outer blade and inner cutter of an embodiment of the present invention and FIG. 3C is a partly sectioned view of a shaver head part showing them as assembled.
Figure 3C:
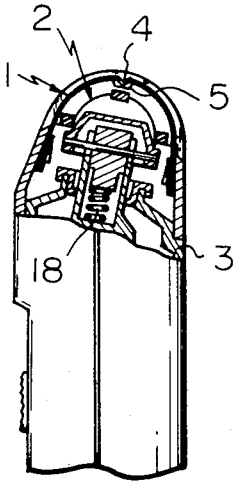
Figure 3B:
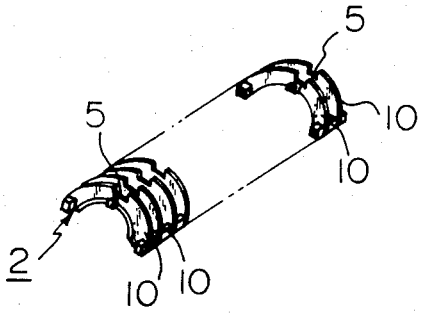
Figure 21:
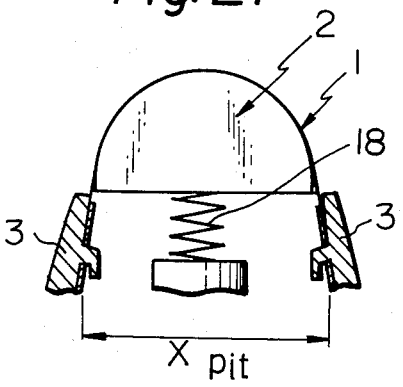
FIG. 21 is a schematic sectioned view showing an outer blade as fixed to the shaver body.
Figure 23:
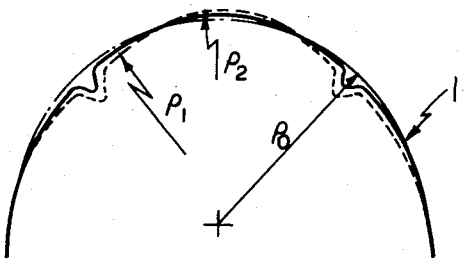
FIGS. 23 and 24 are respectively an explanatory view of the bent shapes of the outer blades in FIGS. 6 and 5.
Figure 24:
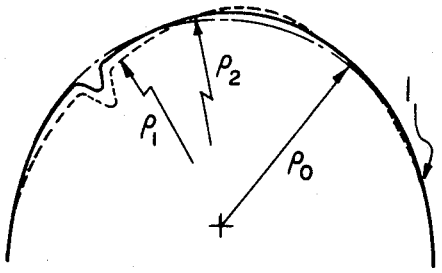

Now, if the preliminary bent part 4 as has been described is provided in the outer blade 1 of the flexible steel foil, such problems as in the following will be produced. That is, the outer blade 1 is fixed on both side edges to the electric shaver body 3 as shown in FIG. 3C or 21 and the inner cutter 2 is resiliently biased so as to keep a contact pressure with the inner surface of the outer blade 1 by means of a push-up spring 18. If, in this case, the radius of curvature of the flexible outer blade 1 retained with its own resiliency without being subjected to the biasing force of the inner cutter when the blade is fixed at the both side edges to the shaver body at a fixing pitch Xpit is coinciding with the radius of curvature of the cutting edges of the inner cutter 2, the outer blade 1 and inner blade body 2 will be in ideal intimate contact with each other and, even if the force of pushing up the inner cutter 2 is small, a favorable cutting efficiency will be obtained. However, the bent part 4 provided in the outer blade 1 acts as a part high in the bending rigidity in the directions transversing the bent part 4 which is parallel to the longitudinal axis of the outer blade 1 once the blade is bent to be semicylindrical, and the outer blade 1 no longer retains a uniform radius of curvature. Therefore, the shape of the cross-section of the outer blade will be as shown by broken lines in FIGS. 22 to 24, a gap $\delta$ will be produced partly as shown in FIG. 25 from the arcuate cutting edge of the inner cutter 2 formed with a uniform radius of curvature, that is, from the ideal radius of curvature $\rho_o$. Even if a proper push-up force is applied to the inner cutter 2 by the spring 18, this gap $\delta$ cannot be eliminated. The gap $\delta$ is produced because the bent part 4 is high in the rigidity due to the plastic bending working, its vicinities are also hard to uniformly bend under the influence of the bent part 4 and, when the entire outer blade 1 is semicylindrically bent, the radius of curvature $\rho_1$ of the vicinity of the bent part 4 will be larger than the radius of curvature $\rho_2$ of the other flat surface part 9. If the bending rigidity of the bent part 4 is the same as the bending rigidity of the flat surface part 9, such gap $\delta$ will not be produced, but it is substantially impossible to reduce the bending rigidity of the bent part 4 to be the same as the bending rigidity of the flat surface part 9 and it is not rather preferable to reduce the rigidity because the vicinities of the bent part 4 involve many chances of the interference with the edges 13 in the cutting edges of the inner cutter blades 10. Therefore, in the present invention, the bending rigidity in the transversing directions of the flat surface part 9 is varied in response to the distance from the bent part 4 to thereby obtain a uniform radius of curvature. That is, the flat surface part 9 is sectioned into a plurality of zones "i" to "iv" which are parallel with the bent part 4 as shown in FIG. 20A in response to the distance from the bent part 4 and the bending rigidity is increased so as to be of a value close to the bending rigidity of the bent part 4 in these zones nearer to the bent part 4. As a result, when the outer blade 1 is semicylindrically bent, the radii of curvature $\rho_1$ and $\rho_2$ of the respective zones will have no extreme head and will smoothly vary, whereby the intimate contact of the outer blade 1 and inner blade 2 with each other will improve as shown by the solid lines in FIGS. 22 to 24. The bending rigidity may vary stepwise sequentially in the respective zones "i" to "iv" but, preferably, it should vary continuously. In the zone, for example, "iv" which is separated sufficiently far from the bent part 4, on the other hand, the bending rigidity needs not be always the minimum.

Referring to a practical example, provided that, when the bending rigidity of the bent part 4 is Go and that of the flat surface part 9 is all 0.6Go, such gap $\delta$ as shown by a broken line in FIG. 26 is produced between the outer blade 1 and the inner cutter 2 in one lateral direction X from the axis of the semicylindrical outer blade 1, the generated amount of the gap $\delta$ can be reduced as shown by the solid line in FIG. 26 when only the bending rigidity of the zone close to the bent zone 4 and indicated by "i" in FIG. 20A is increased to be 0.8Go and that of the other zone is made 0.6Go and, when the bending rigidities of the zones "i" and "ii" are made 0.8Go and 0.7Go, respectively while those of the zones "iii" and "iv" are both made 0.6Go, that is, the bending rigidity is reduced continuously as separated from the bent part 4, the generated amount of the gap $\delta$ will further reduce as shown by a chain line in FIG. 26, wherein the abscissa X represents the distance from the middle of the outer blade and the ordinate represents the amount of the gap $\delta$. Here, the amount of the gap $\delta$ is obtained by experiments and computations under such conditions that the developed length L including the both side fixing parts of the outer blade 1 is 33 mm., the depth H of the bent part 4 is 0.3 mm., the width W of the bent part 4 is 0.3 mm., the fixing pitch $X_{pit}$ of the outer blade is 16 mm., the radius of the cutting edges of the inner cutter 2 is 6.5 mm. and the push-up force is 400 g. Further, each of the zones "i" to "iv" is of a width of 2.5 mm. The zone "i" excludes the zone "v" in which the slit-shaped apertures 6 are provided across the bent part 4.

Figure 28:
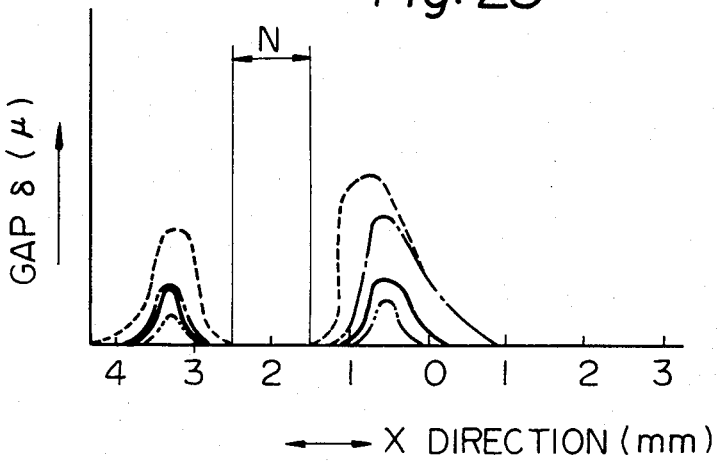

The outer blade 1 shown in FIG. 6 is of the case where two bent parts 4 and 4' are provided to be symmetrical with each other. In this case, if all the bending rigidities of the flat surface part 9 are identical, the parts adjacent the bent parts 4 and 4' of the outer blade will produce the largest gap (see broken lines in FIG. 27). However, when the bending rigidity of the flat surface part 9 is reduced sequentially in response to the distances from the respective bent parts 4 and 4', that is, in response to the distance from the nearer one of the bent parts, the outer blade 1 will describe a curve approximate to an ideal radius of curvature as shown by the solid line in FIG. 23 and, as a result, the amount of the gap $\delta$ will reduce as shown by the solid line and chain line in FIG. 27. Further, in an embodiment where a single bent part is provided asymmetrically as separated from the longitudinal center or axis of the outer blade (FIG. 5), a uniform bending rigidity throughout the respective zones of the flat surface parts 9 will render the curvature to be as shown by broken lines in FIGS. 24 and 28. However, if the rigidity is only varied in response to the distance from the bent part 4, as shown by single-dotted chain line in FIG. 28, the generated amount of the gap $\delta$ cannot be effectively controlled. In this case, if the bending rigidity of the zone "vi" shown in FIG. 20 to be in the symmetrical position to the bent part 4 with respect to the longitudinal axis of the outer blade is made to be of a value very close to that of the bent part 4 while the bending rigidity of other flat surface part 9 is reduced sequentially in response to the distance from either of the bent part 4 and its symmetrical rigid zone "vi" whichever is nearer, the generated amount of the gap $\delta$ can be reduced as shown by solid line or double-dotted chain line in FIGS. 24 and 28. In FIGS. 26 to 28, N denotes an extent in which the bent part 4 and corresponding undulated part 5 are present and is not effective to cut hair.

Figure 49:
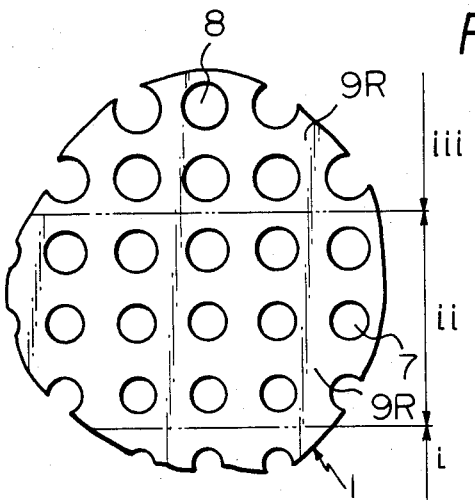
FIGS. 49 to 51 are fragmentary plan views of the outer blades in different embodiments according to the present invention.
Figure 50:
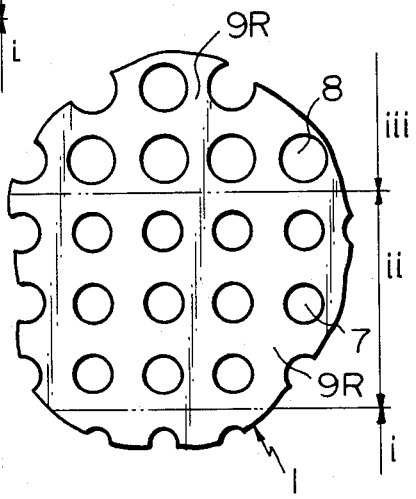
Figure 51:
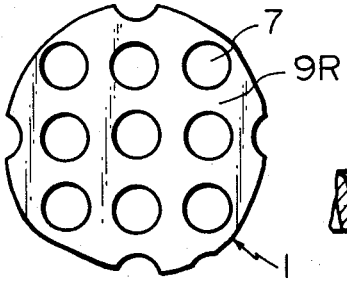
Figure 52:
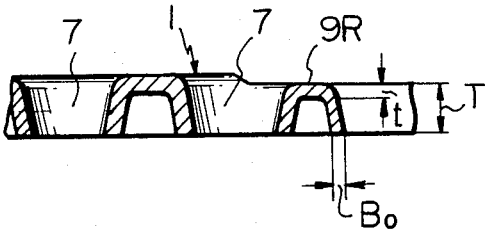
FIG. 52 is a partly sectioned view of the outer blade shown in FIG. 51.

As possible measures for varying the bending rigidity of the outer blade in the respective zones, the followings are suggested. First, since the bending rigidity G is inversely proportional to the ratio $\phi = S_1/S_2$ of the area $S_1$ of all the apertures in the flat surface parts 9 to the area $S_2$ of the rib 9R located between and defining the respective apertures (G oC $1/\phi$), the area of the respective apertures in the zone close to the bending part 4 or to the rigid zone "vi" is reduced while the apertures are distributed at a fixed distance between respective centers of the apertures as, that is, the width of the rib 9R is made sequentially larger, as shown in FIGS. 49 and 50, wherein FIG. 49 is of an example where the aperture diameter is continuously varied and FIG. 50 is of an example where the diameter is varied stepwise through the respective zones. Further, the bending rigidity is also proportional respectively to the blank material thickness t of the steel foil, total height (blade thickness) T of the rib 9R and bottom surface width (land width) Bo of the cutting edge as shown in FIG. 52. Even if the area of the apertures is made constant as shown in FIG. 51, therefore, the nearer to the bent part 4 or to the symmetrical rigid zone "vi", the larger at least one of the blade thickness T, material thickness t and land width Bo may be made so that the bending rigidity can be varied as desired.

Figure 22:
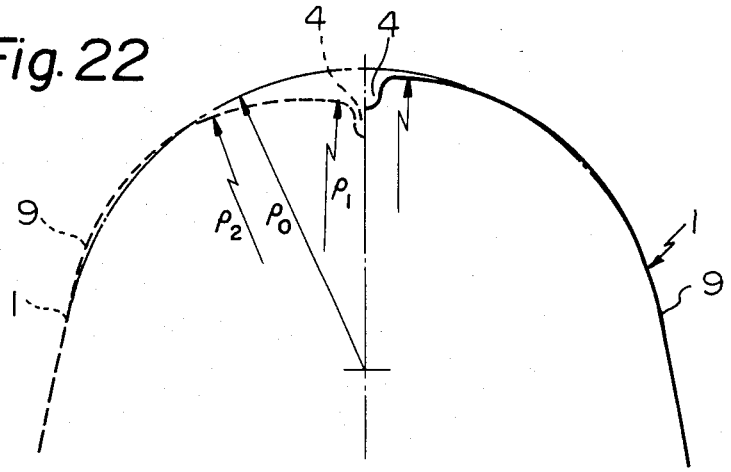
FIG. 22 is an explanatory view of the shape of the outer blade of FIG. 4 as bent to be semicylindrical.
Figure 53:
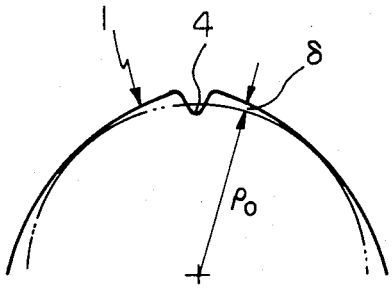
FIGS. 53 to 56 are explanatory views of the shapes of outer blades in the bent state of the present invention.
Figure 54:
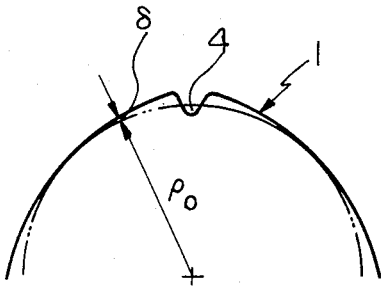
Figure 55:
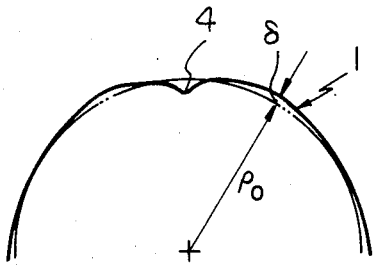
Figure 56:
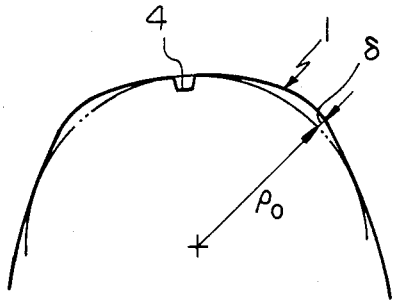
Figure 57:
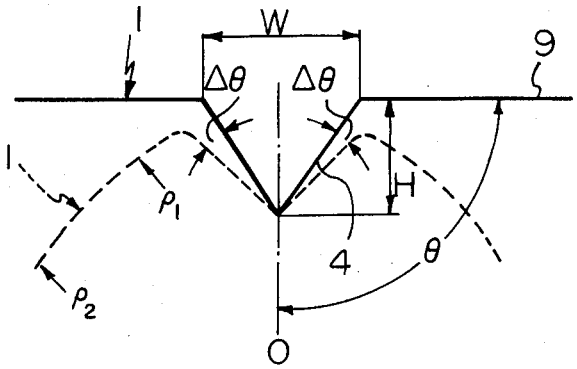
FIGS. 57 and 58 are explanatory views of actions accompanying the fixing bending adjacent the preliminary bent part of the outer blade of the present invention.
Figure 58:
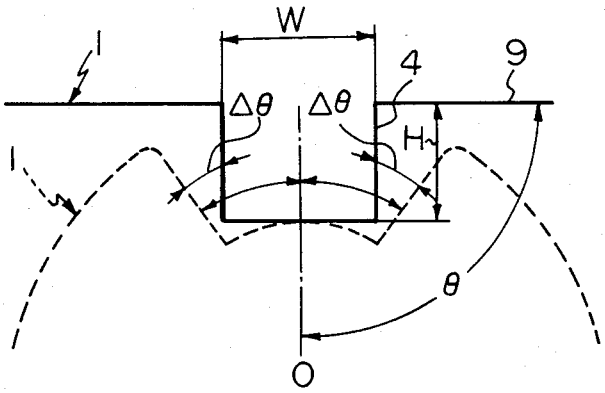
Figure 59:
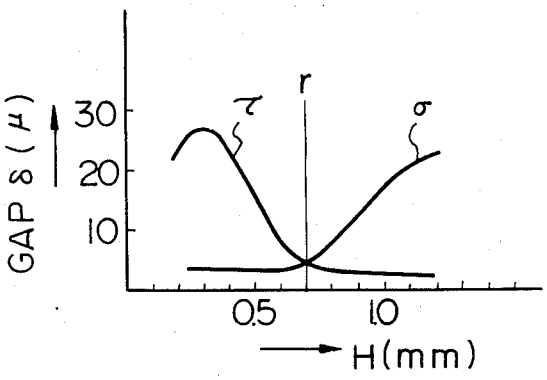
FIG. 59 is a characteristic diagram showing the correlation between the depth of the bent part of the outer blade and the generated amount of gap between the inner and outer blade.

Referring to the case where the semicylindrically bent outer blade 1 will be of such uneven shape as shown by broken line in FIG. 22 or in FIG. 55 or 56, this happens when the depth H of the bent part 4 is not higher than a certain value and, if the depth H of the bent part 4 is made larger, the gap $\delta$ will become maximum adjacent the bent part as shown in FIGS. 53 and 54. While the gap $\delta$ is of course generated for various reasons, the influence of the depth H of this bent part is particularly large. That is, when such other conditions as, for example, the width W of the bent part 4, fixing pitch $X_{pit}$ of the outer blade 1, developed length L of the outer blade 1, bending rigidity of the flat surface part 9 of the outer blade 1 and push-up force for the inner cutter 2 are made identical while the depth H of the bent part 4 exceeds the certain value, the gap $\delta$ will be maximum adjacent the bent part 4 as shown in FIGS. 53 and 54 and, when the depth H is made less than the certain value, the gap $\delta$ will be maximum in the flat surface part 9 close to the bent part 4 as shown in FIGS. 55 and 56. That is, when the depth H of the bent part 4 is large, as shown in FIGS. 57 and 58, the value of the displacement angle $\Delta\theta$ of the side walls of the bent part 4 when the outer blade 1 is bent becomes large, whereby the radius of curvature $\rho_1$ near the bent part 4 is made larger than the radius of curvature $\rho_2$ of the flat surface part 9 and, as shown in FIGS. 53 and 54, the value of the gap $\delta$ will become maximum near the bent part. On the contrary, if the depth H is small, the displacement angle $\Delta\theta$ will be small, the radius of curvature $\rho_1$ will become smaller than the radius of curvature $\rho_2$ and the value of the gap $\delta$ will become maximum in the flat surface part 9. FIG. 68 shows this relationship, wherein the abscissa represents the depth H of the bent part 4, the ordinate represents the gap $\delta$, $\sigma$ represents the value of the gap $\delta$ in the bent part 4 and $\tau$ represents the valve of the gap $\delta$ in the flat surface part 9. Therefore, when the depth H is of this value ($\gamma$ in FIG. 59), the value of the gap $\delta$ will be minimum and the intimate contact of the inner cutter 2 with the outer blade 1 can be improved.

Figure 60:
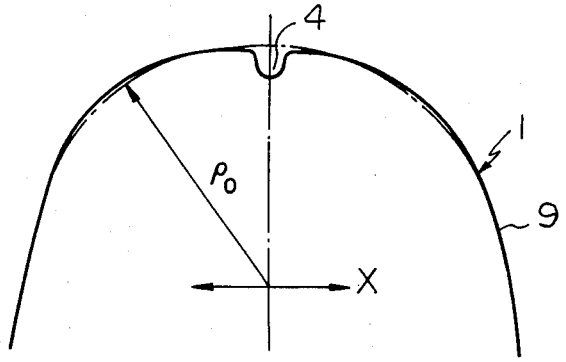
FIG. 60 is an explanatory view of the shape of the outer blade of the present invention when the blade is bent for the fixing to the shaver head.

In order to efficiently introduce such long hair as has been referred to, however, it is not always most preferable that the depth of the bent part 4 is of this value $\gamma$. In such case, the following measures can be taken. As in FIGS. 57 and 58, the angle $\theta$ formed by the symmetrical axis 0 of the bent part 4 and the flat surface part 9 of the outer blade 1 before being bent is usually 90 degrees, and the the value $\gamma$ of the depth H is also the one obtained on the basis of the premise that this angle $\theta$ is a right angle, but the particular angle $\theta$ is suggested to be made an acute angle or obtuse angle. Now, when the depth H exceeds the certain value $\gamma$ and the angle $\theta$ is made an obtuse angle larger than the right angle, the radius of curvature $\rho_1$ in the bent part 4 will become smaller than in the case where the angle $\theta$ is a right angle and will become close to the value of the radius of curvature $\rho_2$ in the flat surface part. Further, when the depth H is less than the certain value $\gamma$ and the angle $\theta$ is made an acute angle, the radius of curvature $\rho_1$ will become larger than in the case where the angle $\theta$ is a right angle and will become close to the value of the radius of curvature $\rho_2$. That is, as shown in FIG. 60, the radius of curvature of the outer blade 1 will become uniform in the respective zones, the intimate contact with the inner cutter 2 having edges of a fixed radius of curvature $\rho_o$ on the entire edge will improve and a favorable cutting efficiency can be obtained with a smaller inner cutter push-up force.

Figure 61:
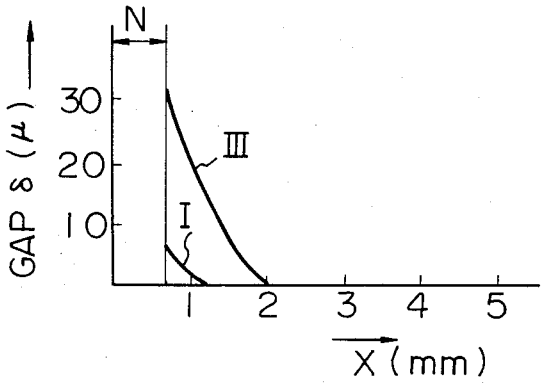
FIGS. 61 and 62 are characteristic diagrams each showing the correlation between the generating position and amount of the gap between the inner and outer blades.
Figure 62:
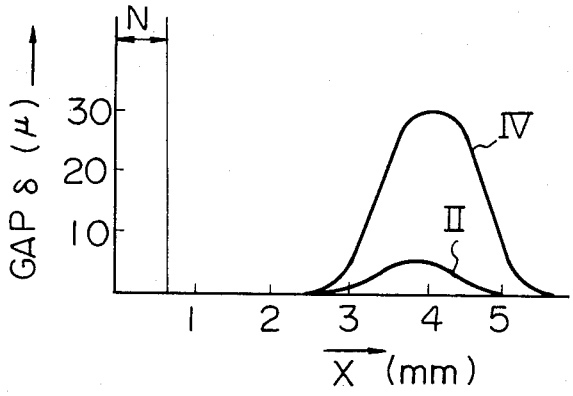

Experiments show that, when the width W of the bent part 4 is 0.3 mm, the fitting pitch $X_{pit}$ of the outer blade 1 is 16 mm., the developed length L of the outer blade 1 is 33 mm., the push-up force for the inner cutter 2 is 400 g. and the radius of the inner cutter blade 10 is 6.5 mm., the preferable value $\gamma$ of the depth h of the bent part 4 is 0.7 mm., and favorable result has been obtained when (I) this depth H is 0.9 mm. and the angle $\theta$ is made 93 degrees, or (II) the depth H is 0.3 mm. and the angle $\theta$ is made 87 degrees, the generated amount of the gap $\delta$ in which cases (I) and (II) are shown by curves I and II in FIGS. 61 and 62. In the drawings, the curve III shows the case where the depth H is 0.9 mm. and the angle $\theta$ is 90 degrees, and the curve IV shows the other case where the depth H is 0.3 mm. and the angle $\theta$ is 90 degrees.

Figure 63:
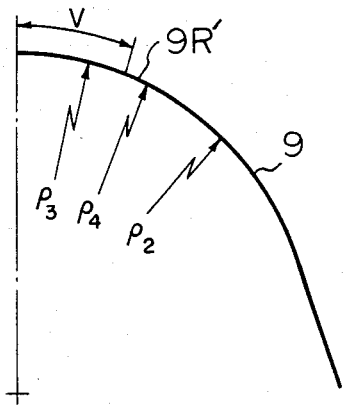
FIG. 63 is an explanatory view showing the distribution of radii of curvature when the outer blade is bent for the fixing.
Figure 64:
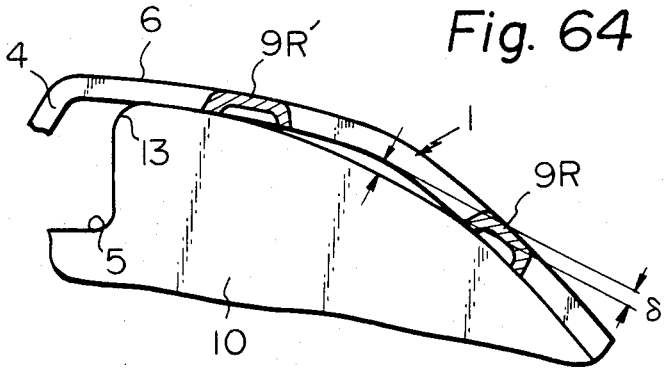
FIG. 64 is a fragmentary sectioned view as magnified of the inner and outer blades showing the gap between them.
Figure 65:
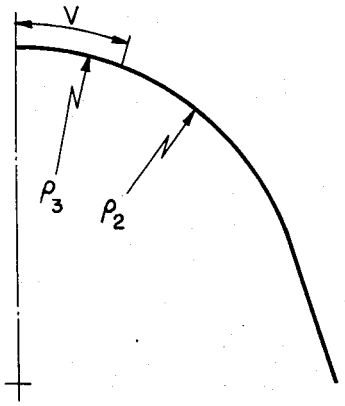
FIG. 65 is an explanatory view showing the distribution of radii of curvature of an improved outer blade when bent for the fixing.
Figure 67B:
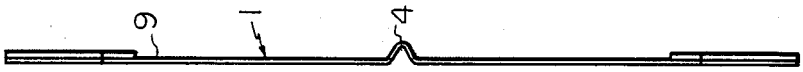
Figure 67A:
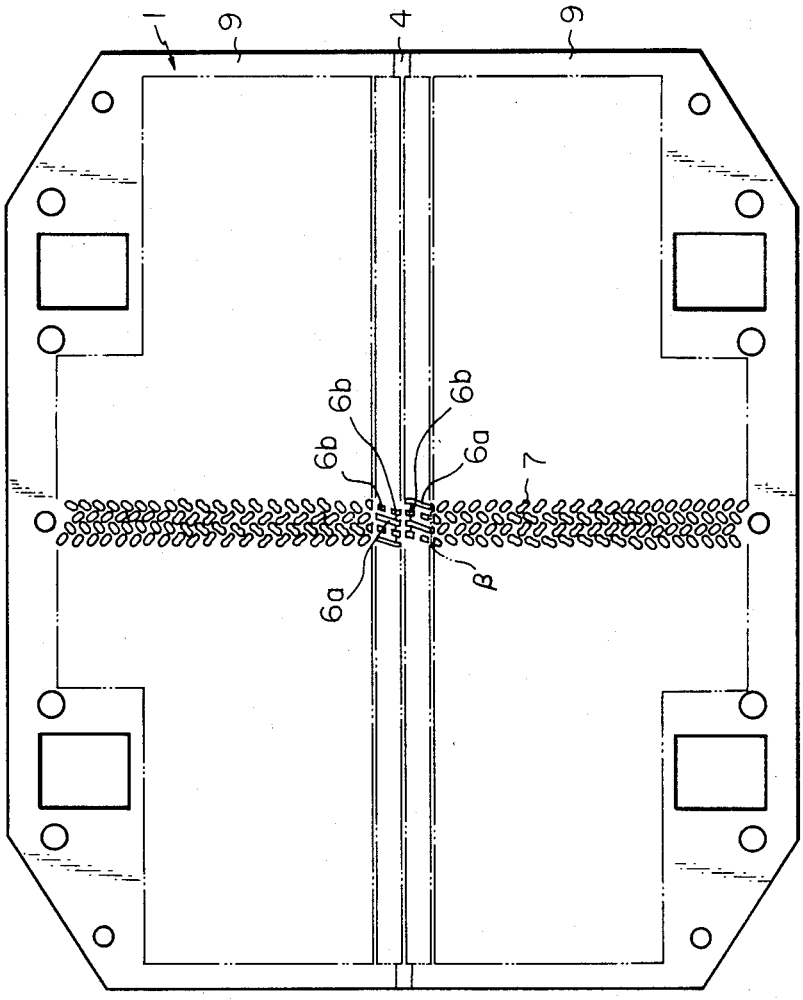

Further, in order to control or restrain the generation of the gap $\delta$, it is effective to reduce the bending rigidity near the bent part 4 by such means as referred to in the followings. As has been described, the bending rigidity of the bent part 4 itself is larger than that of the flat surface part 9 and, unless it is larger, the interfering displacement of the bent part 4 toward the inner cutter 2 becomes larger than that of the flat surface part 9. Therefore, in order to secure the strength, the rigidity of the bent part 4 must be larger. On the other hand, the both side parts of the bent part 4 also have a high bending under the influence of the bent part 4. In the embodiment shown in FIG. 4 and others, the boundary line $\beta$ (FIG. 20A) between the slit-shaped apertures 6 and the other apertures 7 and 8 in the flat surface part 9 is a straight line parallel with the reciprocating directions of the inner cutter 2 so that the rib 9R' (FIG. 63 or 64) present on the boundary line $\beta$ is linear and has a strong resistance or rigidity in the semicylindrically bending direction of the outer blade 1, the radius of curvature $\rho_4$ of the rib 9R' on the boundary line $\beta$ becomes larger than the radius of curvature $\rho_3$ of the zone "v" in which the slit-shaped apertures 6 are present as shown in FIG. 63, a difference in respective bends of the rib 9R' and flat surface part 9 which has the smallest radius of curvature $\rho_2$ becomes remarkable, and an undesirable gap $\delta$ is generated with respect to the inner cutter 2 as shown in FIG. 64 by the linear rib 9R'. Conversely speaking, if the bending rigidity of the rib 9R' on the boundary line $\beta$ is made small, the amount of the gap $\beta$ will become small. As shown in FIG. 66A or 67A, therefore, in an arrangement of the slit-shaped apertures 6 formed of two different kinds of the long slit-shaped apertures **6*a* and short slit-shaped apertures 6*b* which are alternately arranged, terminating positions of these alternate apertures 6*a* and 6*b* on the side of the boundary line $\beta$ are made different so that the line $\beta$ will be zigzag in the reciprocating direction of the inner cutter. As a result, the rib 9R' on the boundary line $\beta$ will be no longer linear, whereby a large bending rigidity will not concentrate in the specific parts in the bending directions of the entire outer blade 1, the bending rigidity will substantially reduce and, as shown in FIG. 65, any part having the maximum radius of curvature $\rho_4$ will be eliminated and the intimate contact between the outer blade 1 and inner cutter 2** can be effectively achieved.

The bending rigidity of the bent part 4 itself may also be reduced by providing further slit-shaped apertures 20 as shown in FIGS. 68 to 71 in the bottom part of the bent part 4. FIG. 70 shows the aperture 20 provided across the both side walls of the bent part 4, whereas FIG. 71 shows the aperture 20 provided to further extend into the adjacent flat surface part 9 to further reduce the bending rigidity of the bent part 4. When the apertures 20 are thus formed in the bent part 4, the bending rigidity of the outer blade 1 upon being bent to be semicylindrical can be reduced in the longitudinal direction of the blade 1 notwithstanding the provision of the bent part 4, so that the outer blade 1 will be easy to bend into a desired semicircular shape, any strain along the bent part 4 due to the plastic bending working can be suppressed and, as a result, the intimate contact of the outer blade 1 with the inner cutter 2 can be improved. In this connection, FIG. 72 shows a case where the bent part 4' is projected on the outer surface of the outer blade and the further slit-shaped apertures 20 are provided in the top: In this case, the inner cutter blade 10 has a corresponding part projected into the projected bent part 4' as shown by 5', the tip of which is corresponding part 5' brought into contact with the inner edges of the apertures 20 to cut hair.

With reference to the before described saddle-shaped deflection, as shown in FIG. 73, generated when the outer blade 1 is bent to be semicylindrical can be compensated by effectively utilizing the further apertures 20 provided in the bent part 4. As will be clear from the magnified views of the parts E and F of FIG. 68A which are shown respectively in FIGS. 74 and 75, the area $S_1$ of each aperture 20 is made larger at regions adjacent the both longitudinal ends of the outer blade 1 and thus the width of ribs 20R between these apertures 20 is made smaller in these regions, whereby the bending rigidity of the outer blade in the longitudinal direction (vertical to the semicircularly bending direction) can be made smaller than in the middle part. Varying thus the bending rigidity in the inner cutter's reciprocating direction, the generation of the saddle-shaped deflection can also be suppressed. Further, at the time of using the shaver, generally the distribution of the forces pushing the outer blade 1 against the face skin will be larger in the middle and smaller at both ends of the outer blade 1 in the inner cutter's reciprocating direction. The present embodiment deals also effectively with this respect to improve the intimate contact of the inner and outer blades particularly at the both ends in the inner cutter's reciprocating direction and the ability of the outer blade 1 to follow the inner cutter's cutting edges. Instead of varying the area of the apertures 20 and the area ratio of the rib 20R between the apertures 20, it may be also effective to adjust the blade thickness T, material thickness t and land width $B_o$ in the bent part 4, so that the bending rigidity at the both end parts in the longitudinal direction of the outer blade, that is, in the inner cutter's reciprocating direction will be made small.

With respect to such driving characteristic due to general formation of inner cutter driving mechanism that the displacement in the vertical direction Y of the inner cutter 2 driven to reciprocate is large at the both ends in the reciprocating direction which are separated from the middle part at which the inner cutter is operatively coupled to the driving mechanism whereas the displacement of the inner cutter 2 in the direction X intersecting at right angles the inner cutter's reciprocating direction is also large at the both longitudinal ends in the reciprocating direction, it is preferable that, as shown in FIGS. 68A and 77, the apertures 20 are not provided in the bent part 4 at the both longitudinal ends including a part of the contact range of the outer blade 1 with the inner cutter 2 adjacent the respective ends thereof since, if the apertures 20 are provided only at the both ends in the reciprocating direction of the inner cutter 2, as shown in FIG. 76, the cutting edges of the blades 10 will enter the apertures 20 to be likely to break the outer blade 1.

Thus, according to the present invention, the flexible outer blade to be fixed to the shaver body as bent semi-cylindrical is provided with a preliminarily bent part in parallel with the reciprocating direction of the inner cutter the respective blades of which are provided with the undulated part in their cutting edge at the position corresponding to the bent part of the outer blade, whereby the outer blade is provided with the hair inlet apertures including in particular the slit-shaped apertures reaching the flat surface part from the bent part, so that even the long hair which is normally hard to shave can be efficiently introduced into the slit-shaped apertures and cut therein as efficiently raised and caught by means of the bent part and slit-shaped apertures.

Further, as a countermeasure against the variations in the ratius of curvature at the time of semicylindrically bending the outer blade due to the preliminary provision of the bent part, the bending rigidity in the bending direction of the flat surface parts adjacent the bent part is made higher than that of the other flat surface parts remote from the bent part but lower than that of the bent part by means of, for example, varying the diameters of the hair inlet apertures in the bending direction of the outer blade so that the radii of curvature of the respective parts when the flexible outer blade is bent semicylindrically will vary smoothly gradually, whereby the value of the gap between the outer blade and the inner cutter blade edges can be made small and a favorable cutting efficiency can be obtained.

In varying the diameters of the hair inlet apertures as referred to in the above, the apertures in the zone the bending rigidity of which is made comparatively large are made to be, for example, circular holes of small diameters, the apertures in the other zone the rigidity of which is made comparatively small are made slots or apertures of the similar shapes, and these apertures of different diameters are arranged in the respective zones parallel to the bent part in the direction intersecting at right angles the reciprocating direction of the inner cutter so that, when the electric shaver is moved along the user's face skin, any point on the skin will contact sequentially the small hole, slot and slit-shaped aperture, the catching and cutting of comparatively long hair by the slots and the same actions for short hair by the small holes are performed in addition to the raising, catching and cutting of the long hair lying along the face skin by the bent part and its slit-shaped apertures, whereby beard hair in all states can be shaved short in a short time without being left unshaved.

In addition to such bending rigidity variations in the bending direction intersecting at right angles the inner cutter's reciprocating direction as has been described, the apertures are also provided in the zone with which the inner cutter does not contact, the slits are also in the bent part or the rib along the bent part is formed nonlinear so that the deflection of the outer blade in its longitudinal direction along the inner cutter's reciprocating direction which is caused when ordinary flat net-shaped steel foil having hair inlet apertures of the kind referred to is semicylindrically bent can be optimumly reduced at least in the zone with which the inner cutter contact and slides therealong, whereby the contact pressure between the outer blade and the inner cutter in their longitudinal direction is kept substantially uniform and an excellent shaving effect can be obtained.

What we claim is:

1. A reciprocable blade assembly for an electric shaver comprising an outer blade made of a flexible steel foil having a plurality of hair inlet apertures and being bent from a flat shape into a substantially semi-cylindrical shape and fixed to the head part of said shaver to form a semi-cylindrical outer blade, and an inner cutter including a plurality of blades each having an arcuate cutting edge and integrally supported substantially parallel with each other so that said cutting edges contact the inner surface of the semi-cylindrical outer blade, said inner cutter being reciprocably mounted to slide along the inner surface of the outer blade in the direction of the longitudinal axis of said semi-cylindrical outer blade, said outer blade being provided with an elongated bent part recessed inwardly and extending in a direction parallel to said longitudinal axis of the semi-cylindrical outer blade, said bent part including side walls extending to adjacent surface parts of the outer blade on both sides of said bent part, said hair inlet apertures including a plurality of slit-shaped apertures disposed within said side walls and extending transversely of said direction and outwardly to said adjacent surface parts of the outer blade, said arcuate cutting edges of said blades of the inner cutter being provided with an edge defining an incision for receiving the recessed bent part of the outer blade, each of said slit-shaped apertures comprising a portion disposed in said side walls and intersecting at right angles the longitudinal axis of the outer blade and a portion disposed in said adjacent surface parts, said hair inlet apertures further comprise shorter slits disposed in said adjacent surface parts and longer slts longer than said shorter slits but shorter than the slit-shaped apertures disposed in the adjacent surface parts, said bent part of the outer blade being substantially V-shape in cross-section, and said incision of the respective inner cutter blades being substantially U-shaped having a bottom edge spaced from a tip end of said V-shaped bent part, restricting means being provided in said U-shaped incision of the inner cutter blades, said restricting means having a groove receiving the apex of said V-shaped bent part of the outer blade and opposing the apex through a slight clearance.

2. A reciprocable blade assembly for an electric shaver comprising an outer blade made of a flexible steel foil having a plurality of hair inlet apertures and being bent from a flat shape into a substantially semi-cylindrical shape and fixed to the head part of said shaver to form a semi-cylindrical outer blade, and an inner cutter including a plurality of blades each having an arcuate cutting edge and integrally supported substantially parallel with each other so that said cutting edges contact the inner surface of the semi-cylindrical outer blade, said inner cutter being reciprocably mounted to slide along the inner surface of the outer blade in the direction of the longitudinal axis of said semi-cylindrical outer blade, said outer blade being provided with an elongated bent part recessed inwardly and extending in a direction parallel to said longitudinal axis of the semi-cylindrical outer blade, said bent part including side walls extending to adjacent surface parts of the outer blade on both sides of said bent part, said hair inlet apertures including a plurality of slit-shaped apertures disposed within said side walls and extending transversely of said direction and outwardly to said adjacent surface parts of the outer blade, said arcuate cutting edges of said blades of the inner cutter being provided with an edge defining an incision for receiving the recessed bent part of the outer blade, each of said slit-shaped apertures comprising a portion disposed in said side walls and intersecting at right angles the longitudinal axis of the outer blade and a portion disposed in said adjacent surface parts, said hair inlet apertures further comprise shorter slits disposed in said adjacent surface parts and longer slits longer than said shorter slits but shorter than the slit-shaped apertures disposed in the adjacent surface parts, said bent part of the outer blade being substantially V-shape in cross-section, and said incision of the respective inner cutter blades being substantially U-shaped having a bottom edge spaced from a tip end of said V-shaped bent part, a restricting means being provided at the apex of said V-shaped bent part of the outer blade, said restricting means having a surface opposing the bottom of said U-shaped incision of the inner cutter blades through a slight clearance.

* * * * *